US006945482B2

(12) United States Patent
Hollinrake et al.

(10) Patent No.: US 6,945,482 B2
(45) Date of Patent: Sep. 20, 2005

(54) COMBINATION DUMP AND SPREADER APPARATUS

(75) Inventors: Mark S. Hollinrake, Marion, IA (US); Mart E. Ward, Manchester, IA (US); Wade J. Burken, Manchester, IA (US); Glenn Ungerer, Swisher, IA (US)

(73) Assignee: Henderson Manufacturing Company, Manchester, IA (US)

( * ) Notice: Subject to any disclaimer, the term of this patent is extended or adjusted under 35 U.S.C. 154(b) by 207 days.

(21) Appl. No.: 10/212,599

(22) Filed: Aug. 5, 2002

(65) Prior Publication Data

US 2003/0168535 A1 Sep. 11, 2003

Related U.S. Application Data

(60) Provisional application No. 60/362,565, filed on Mar. 7, 2002.

(51) Int. Cl.[7] ..... A01C 19/00

(52) U.S. Cl. ..... 239/672; 239/657; 239/681; 239/687

(58) Field of Search ..... 239/672, 675, 239/676, 677, 665, 657, 661, 681, 682, 687, 176, 172, 673

(56) References Cited

U.S. PATENT DOCUMENTS 2,870,923 A * 1/1959 Jewell, Jr. ..... 414/528
3,790,090 A * 2/1974 Lorenc et al. ..... 239/666
4,583,693 A * 4/1986 Harder ..... 239/657
4,685,619 A * 8/1987 Harder et al. ..... 239/1
4,886,214 A * 12/1989 Musso et al. ..... 239/676
5,400,974 A * 3/1995 Musso et al. ..... 239/672
5,618,002 A * 4/1997 Cervelli et al. ..... 239/657
6,220,532 B1 * 4/2001 Manon et al. ..... 239/672
6,394,735 B2 * 5/2002 Hollinrake et al. ..... 414/519
6,585,472 B2 * 7/2003 Hollinraka et al. ..... 414/489
6,698,997 B2 * 3/2004 Arne et al. ..... 414/502

* cited by examiner

*Primary Examiner*—Patrick Brinson
(74) *Attorney, Agent, or Firm*—Leydig, Voit & Mayer, Ltd.

(57) ABSTRACT

A vehicle is disclosed which includes a chassis and a combination body for selectively dumping and spreading materials. A hoist is provided which extends between the body and the chassis for pivoting the body. A conveyor assembly for selectively conveying materials from the body is also included. A tailgate is pivotally connected to the body and has an opening therein to permit material to be transported therethrough. A rear feed gate assembly for selectively covering the opening of the tailgate is provided. The vehicle includes a rear diverter chute that is operably arranged with the conveyor assembly to direct the materials to a rear spreader. A front feed gate assembly for selectively covering an opening of a front end of the body is provided. First and second side chutes are operably arranged with the conveyor assembly to direct materials to a side spreader and a surface, respectively.

19 Claims, 19 Drawing Sheets

COMBINATION DUMP AND SPREADER APPARATUS

CROSS-REFERENCE TO RELATED APPLICATIONS

This patent application claims the benefit of priority to U.S. Provisional Application No. 60/362,565, filed Mar. 7, 2002, entitled "Combination Dump and Spreader Apparatus," which is incorporated in its entirety herein by this reference.

FIELD OF THE INVENTION

The present invention relates generally to a combination dump and spreader apparatus which, when mounted onto a vehicle chassis, provides for selective dumping and spreading of material from the apparatus, advantageously granular material such as sand, salt and the like, onto surfaces such as roadways.

BACKGROUND OF THE INVENTION

Many types of vehicles are available with an apparatus mounted thereon which provide for both the dumping and spreading of material, such as sand, salt, gravel, asphalt and the like, onto a surface. One type of apparatus which provides this dual functionality is commonly referred to as a combination body. Combination bodies are so named because they provide, in combination, both dumping and spreading functions. Examples of combination bodies are provided by U.S. Pat. Nos. 5,400,974 and 5,772,389.

In general, combination bodies are pivotally mounted onto the chassis of a vehicle, typically a truck chassis. Although the bodies can be mounted so as to pivot in one or more directions, the most common mounting arrangement provides a hinge mechanism on the rear of the body and a hydraulic cylinder on the front or the rear of the body, wherein movement of the cylinder causes the body to pivot about the rear hinge mechanism. This pivoting movement provides the bodies with the ability to dump material from the rear of the bodies.

Conventional combination bodies further include a conveyor system that transports material residing within the body out of the body and into one or more spreaders mounted on the exterior of the vehicle. Such conveyor systems typically include a longitudinal endless conveyor located within the body that transports the material from the front to the rear of the body or, alternatively, from the rear to the front of the body. The former situation typically results in a deposit of the material into a conventional spreader mounted on the rear of the vehicle. In the latter situation, however, the material is transported out of the front of the body, through a gate, and onto another part of the conveyor system—a cross conveyor—mounted on the chassis, and located adjacent the front of the body. The cross conveyor in turn transports the material laterally to the sides of the vehicle, and deposits the material into conventional side-mounted spreaders.

Conventional combination bodies also include a tailgate that covers the rear of the body. As the tailgate is pivotally mounted at the upper corners of the body, the tailgate can pivot into an open position when it is desired to utilize the dumping functionality of the body. Certain tailgates are also pivotally mounted at the lower corners of the bodies, allowing the tailgate to be lowered to assist in cleaning and rear loading.

The tailgates of those conventional bodies further include at least one opening therethrough, with a second opening often provided in the front of the body. The openings provide a means by which the material, upon transport by the endless conveyor, can be expelled from the front and the rear of the body. When spreading is desired, one or both of the openings can be selectively opened or closed by operation of a feed gate mounted so as to cover the opening. The feed gate further provides a means for metering the flow of material through the opening, and into the cross conveyor or the rear-mounted spreader. Upon being expelled from the body through the tailgate opening, the material is directed into the rear spreader at least in part by a cover affixed to the tailgate.

Various cover designs have been utilized in combination bodies. One common type extends forward, into the body itself, and is designed to collapse when the tailgate is lowered. This type of cover, however, has heretofore only been used in bodies wherein the conveyor resides completely within the confines of the body. Another type of cover extends rearwardly from and is affixed to the tailgate. This cover, utilized in bodies wherein the endless conveyor extends rearward of the tailgate, is located above and adjacent to the tailgate opening, and is permanently affixed in this position.

While existing combination dump and spreader bodies provide many desirable features and advantages, there remain certain problems with these combination bodies. For example, spreaders are often provided to complement the spreading feature available in a combination body. The spreaders are typically mounted to the chassis. The mounting of the spreaders can be cumbersome for a dealer to perform. Furthermore, the spreader can be difficult to adjust once it has been mounted. In addition, a feed gate assembly can be provided to selectively control the movement of materials from the body. In use, the feed gate assembly undergoes considerable stress, which can cause deformation in the assembly.

In view of the foregoing, there exist various needs in the art. One such need is for a combination body which provides an easily mounted and readily adjustable spreader. Another need is for a combination body having a stronger feed gate assembly that can more ably withstand the forces to which it is subjected during operation.

SUMMARY OF THE INVENTION

The present invention addresses the foregoing and other needs by providing a combination body for selectively dumping and spreading materials. There is provided a vehicle including, at least, a chassis and a combination body for selectively dumping and spreading materials. The body is pivotably secured to the chassis at a hinge and is comprised of front and rear ends and first and second side walls. A hoist is provided which extends between the body and the chassis for pivoting the body about the hinge. A conveyor assembly is also included, which comprises an endless conveyor disposed between the side walls and extending beyond the rear end of the body. A tailgate is pivotably connected to the rear end of the body and has an opening therein to permit material to be transported therethrough by the endless conveyor.

In one aspect of the present invention, a feed gate assembly for selectively covering the opening of the tailgate is provided. The feed gate assembly comprises first and second support members mounted to the tailgate. A handle is rotatably mounted to the first and second support members. A bailment depends from the handle. The bailment is pivotally mounted to a cover plate, which is movable between a closed position and an open position. The bailment has first and second arms "in close proximity" to the first and second support members, respectively.

In another aspect of the present invention, the conveyor assembly further comprises a cross conveyor located adjacent the front end of the body. The endless conveyor is operable to selectively transport material from the body through the opening of the front end of the body to the cross conveyor. A feed gate assembly for selectively covering the opening of the front end of the body is provided. The feed gate assembly comprises first and second support members mounted to the front end of the body. A handle is rotatably mounted to the first and second support members. A bailment depends from the handle. The bailment is pivotally mounted to a cover plate, which is movable between a closed position and an open position. The bailment has first and second arms in close proximity to the first and second support members, respectively.

In a further aspect of the invention, the vehicle includes a tailgate pivotably connected to the rear end of the body. The tailgate has an opening therein to permit material to be transported therethrough by the endless conveyor. A conveyor cover assembly is provided that includes a cover and a mounting member. The cover has front and rear ends. The front end of the cover is removably mounted to the front end of the body. The rear end of the cover extends rearwardly from the tailgate. The mounting member is secured to the body adjacent the rear end of the body. The rear end of the cover is removably mounted to the mounting member. The cover is configured to completely cover the endless conveyor along the length thereof.

In another aspect of the invention, the vehicle includes a diverter chute that is operably arranged with the conveyor assembly to receive materials from the conveyor assembly. The chute includes a body that defines a passageway and a panel that is movable between a first position and a second position. The panel allows material to move through the chute to the spreader when the panel is in the first position. The panel prevents material from moving through the chute when the panel is in the second position.

In yet another aspect of the invention, the vehicle includes a spreader for selectively spreading materials that is adjustably mounted to the vehicle and cooperatively arranged with the conveyor assembly to receive materials. The spreader is selectively movable along a first axis, a second axis, and a third axis. The hoist can pivot the body about the hinge between first and second positions. The spreader can include a disk, which defines a first spreader plane when the body is in the first position. Advantageously, the spreader can be pivotally mounted with respect to the body such that the disk defines a second spreader plane when the body is in the second position wherein the second spreader plane is substantially parallel to the first spreader plane.

Advantageously, a recess is defined by at least one of the first and second side walls. The recess is configured to accommodate at least one of a storage box and a storage tank. The recess has a recess length at least over fifty percent of the body length.

In a further aspect of the invention, the vehicle includes a spreader for selectively spreading materials. The spreader is mounted to the chassis. A chute is operably arranged with the conveyor assembly to receive materials and direct materials to the spreader. The chute is mounted to the body.

In another aspect of the invention, the conveyor assembly includes a cross conveyor located adjacent the front end of the body. A spreader for selectively spreading materials is cooperatively arranged with the conveyor assembly to receive materials. The spreader is adjustably mounted to the chassis such that the spreader is rotatable about a first axis.

These and other objects and advantages, as well as additional inventive features, of the present invention will become apparent to one of ordinary skill in the art upon reading the detailed description, in conjunction with the accompanying drawings, provided herein.

DETAILED DESCRIPTION OF EMBODIMENTS OF THE INVENTION

Figure 1:
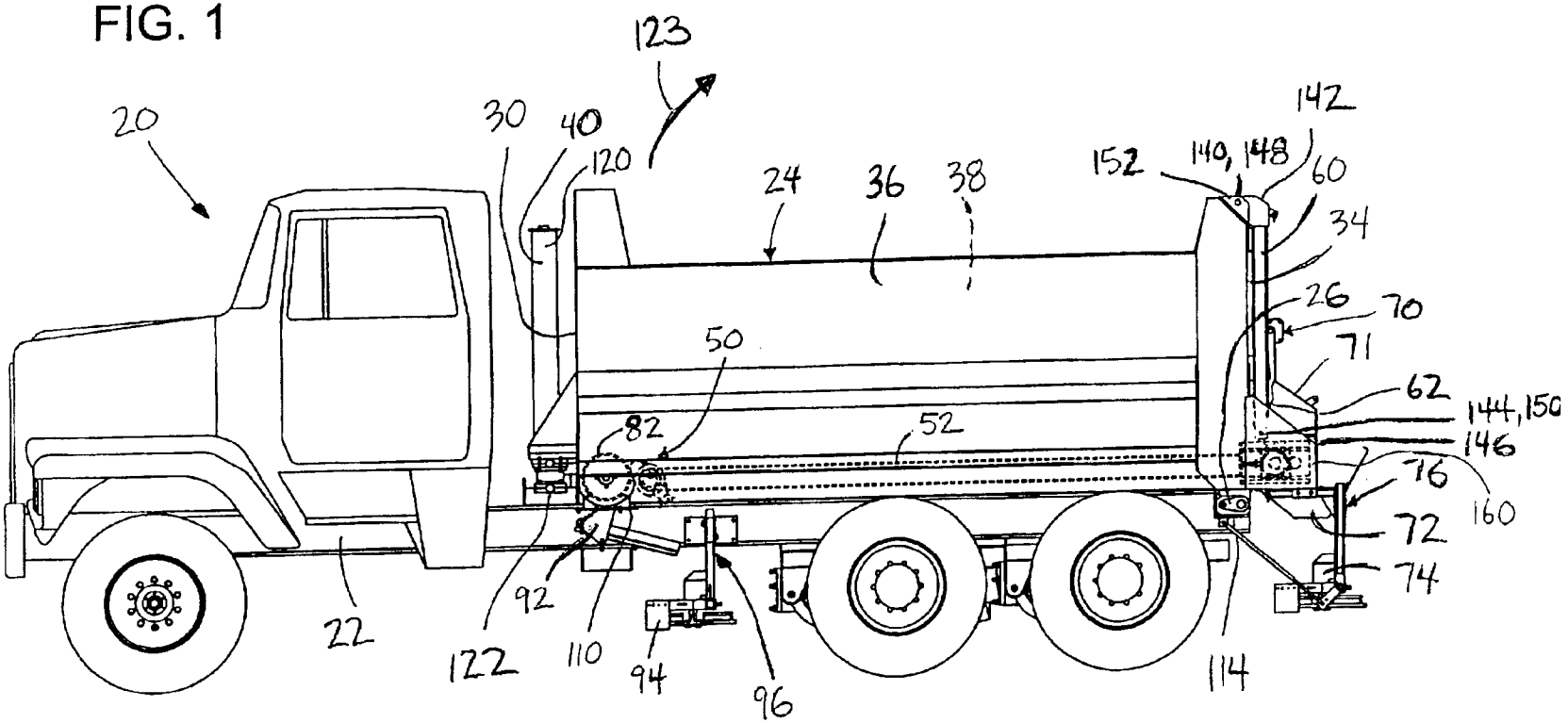
FIG. 1 is a first side elevational view of a vehicle including a combination body in accordance with the present invention.

Turning now to the drawings, there is shown in FIG. 1 an illustrative vehicle 20 including a combined dump and spreader apparatus, also known as a combination body, for dumping and spreading materials in accordance with the present invention. The present inventive vehicle shown and described herein improves upon the vehicle shown and described in U.S. patent application Ser. No. 09/256,053, filed Feb. 23, 1999, and entitled "Combination Dump And Spreader Apparatus," which is incorporated herein by reference in its entirety.

Figure 2:
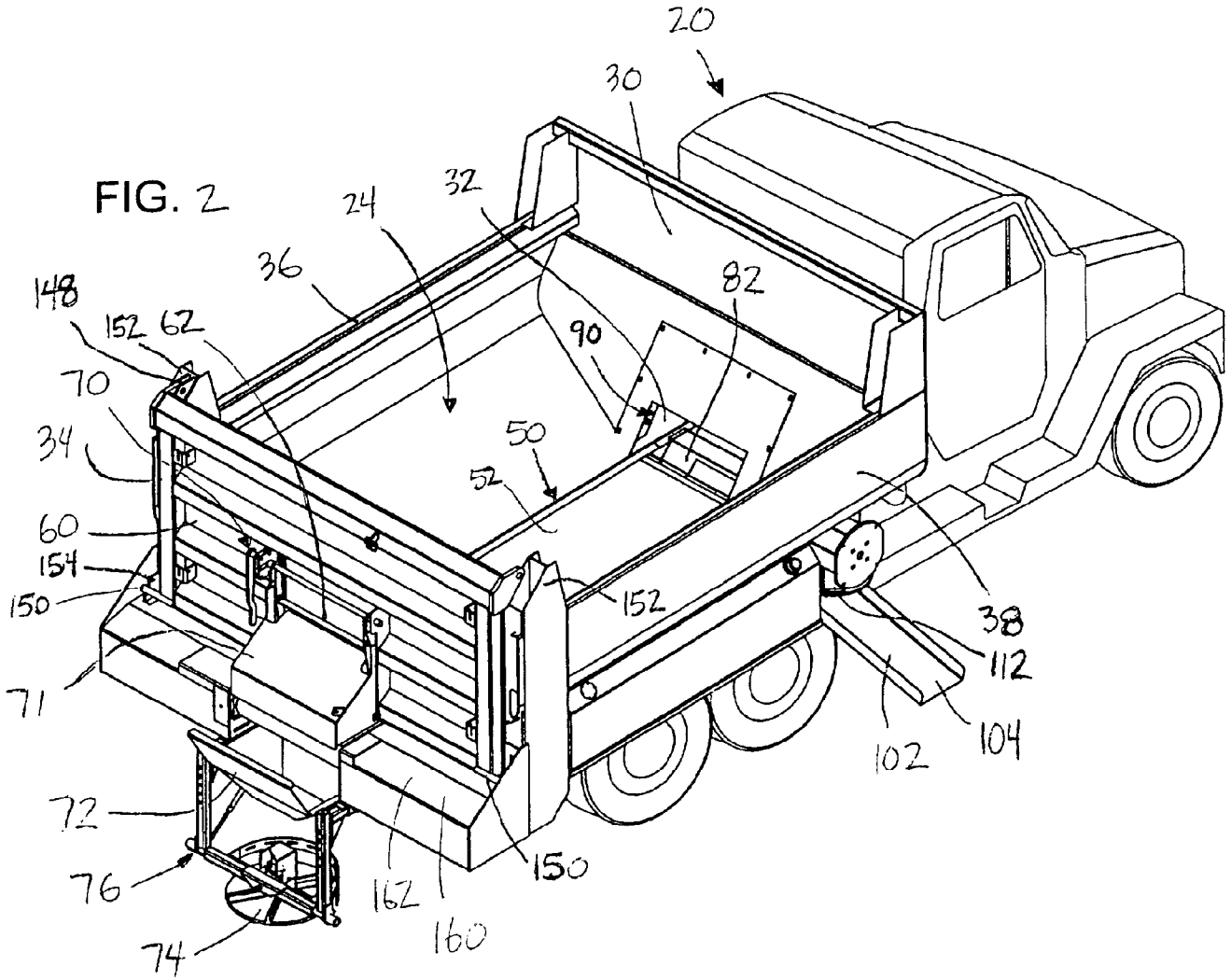
FIG. 2 is a perspective view of the vehicle of FIG. 1 generally from the rear and a second side.
Figure 3:
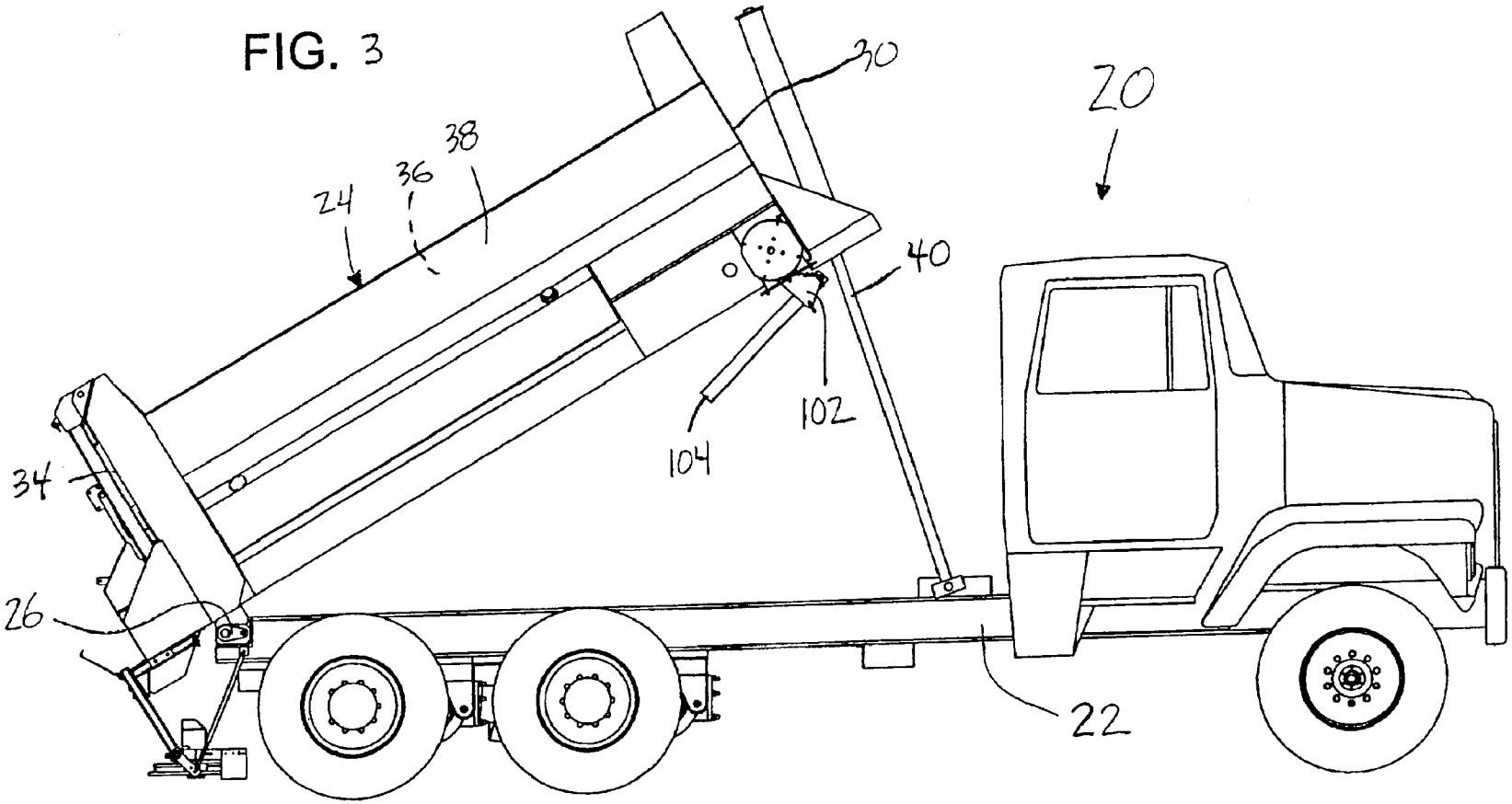
FIG. 3 is a second side elevational view of the vehicle of FIG. 1 showing the body in an inclined position.

Referring to FIGS. 1–3, the vehicle 20 includes a chassis 22 and a combination body 24 for holding materials and for selectively dumping and spreading materials. The body 24 is pivotally mounted to the chassis 22 at a hinge 26. The body 24 includes a front end 30 having an opening 32, a rear end 34, and first and second side walls 36, 38. A hoist 40 is provided which extends between the body 24 and the chassis 22 for pivoting the body about the hinge 26.

Referring to FIGS. 1 and 2, a conveyor assembly 50 for selectively conveying materials from the body 24 is also included. The conveyor assembly 50 includes an endless conveyor 52 disposed between the side walls 36, 38 of the body 24 and extending along the length of the body 24 beyond the rear end 34 of the body 24. The endless conveyor 52 can selectively transport material from the body 24 out the rear end 34 and from the body 24 out the opening 32 of the front end 30. The endless conveyor 52 is similar in construction and operation to the endless conveyor shown and described in U.S. patent application Ser. No. 09/256,053. It will be understood that the endless conveyor 52 can be provided in a variety of configurations, including, for example, but not limited to, an auger.

A tailgate 60 is pivotally connected to the rear end 34 of the body 24 and has an opening 62 therein to permit material to be transported therethrough by the endless conveyor 52. A rear feed gate assembly 70 for selectively covering the opening 62 of the tailgate 60 is provided. A rotatable tailgate cover 71 is provided to assist in properly positioning the material on the endless conveyor 52 as it leaves the opening 62 of the tailgate 60 and in directing the material downwardly onto a rear diverter chute 72. The cover 71 is pivotally mounted to the tailgate 60. The cover 71 extends at least partially over the portion of the endless conveyor 52 that extends beyond the tailgate 60.

The rear diverter chute 72 is operably arranged with the conveyor assembly 50 to receive materials from the endless conveyor 52 and to direct the materials to a rear spreader 74 for selectively spreading materials. A first spreader mounting assembly 76 adjustably mounts the rear spreader 74 to the vehicle 20. The rear spreader 74 is cooperatively arranged with the conveyor assembly 50 to receive materials.

The conveyor assembly 50 further includes a cross conveyor 82 located adjacent the front end 30 of the body 24 and extending generally perpendicular to the endless conveyor 52. The cross conveyor 82 is arranged to selectively transport material received from the endless conveyor 52 to the first side wall 36 and the second side wall 38. The cross conveyor 82 is preferably mounted to the chassis 22. The cross conveyor 82 is illustrated in these figures in its preferred form as an auger.

The cross conveyor 82 is similar in construction and operation to the cross conveyor shown and described in U.S. patent application Ser. No. 09/256,053. It will be understood that the cross conveyor 82 can be provided in a variety of configurations, including, for example, but not limited to, a conventional conveyor belt or chain system with the top surface of the belt or chain defining the upper outer surface of the cross conveyor.

A front feed gate assembly 90 for selectively covering the opening 32 of the front end 30 of the body 24 is provided.

Referring to FIG. 1, a first side chute 92 is operably arranged with the conveyor assembly 50 to receive materials and direct materials to a side spreader 94 for selectively spreading materials. The first side chute 92 is mounted to the body 24 adjacent the first side wall 36. A second spreader mounting assembly 96 adjustably mounts the side spreader 94 to the chassis 22. Referring to FIGS. 2 and 3, a second side chute 102 is operably arranged with the conveyor assembly 50 to receive materials and direct materials to a surface, such as a roadway shoulder. The second side chute 102 includes a burming ramp 104 for depositing materials remotely from the vehicle 20. The second side chute 102 is mounted to the body 24 adjacent the second side wall 38.

Referring to FIGS. 1 and 2, the cross conveyor 82 is arranged to receive materials through the opening 32 of the front end 30 of the body 24 from the endless conveyor 52 and to transport selectively the materials to first and second side discharge ports 110, 112, which are mounted to the first and second side walls 36, 38, respectively. The ports 110, 112 can be arranged to deposit materials into the first and second side chutes 92, 102, respectively.

Referring to FIG. 1, the body 24 is secured to the chassis 22 about a pivot axis 114. More specifically, the body 24 is pivotably secured to the chassis 22 at the hinge 26 which allows for pivotal movement about the pivot axis 114. The hoist 40 includes a hydraulic cylinder 120 connected between the body 24 and the chassis 22 at a selected point 122 forward the pivot axis 114 of the body 24. The hoist 40 is operable to act upon the front end 30 of the body 24 to rotate the body 24 as indicated by an arrow 123 in FIG. 1 on the hinge 26 about the pivot axis 114 from a normal, horizontal position, as seen in FIG. 1, to a fully inclined position, as seen in FIG. 3.

Referring to FIGS. 1 and 2, to facilitate the storage and the selective dumping of materials in the body, the tailgate 60 is provided at the rear end 34 of the body 24 and extends transversely between the side walls 36, 38. The tailgate 60 is releasably and pivotably connected to the rear end 34 of the body 24. The tailgate 60 is selectively pivotable with respect to the body 24 about an upper pivot axis 140 disposed adjacent a top edge 142 of the tailgate 60 and about a lower pivot axis 144 disposed adjacent a lower edge 146 of the tailgate 60. Upper and lower pins 148, 150 extending from the tailgate 60 can be releasably secured to mounts 152, 154 on the body 24 to provide for selective pivotal movement about the upper and lower pivot axes 140, 144 of the tailgate 60.

When the tailgate 60 is secured at both axes 140, 144, the tailgate 60 generally prevents material in the body 24 from exiting the rear end 34 thereof. The tailgate 60 includes the opening 62 therein to permit material to be selectively transported therethrough by the endless conveyor 52 such that the tailgate 60 can remain secured during spreading. The tailgate 60 can be selectively released from the upper pivot axis 140 by releasing the upper pins 148 and pivoted about the lower pivot axis 144, thereby providing for ease in cleaning and rear loading of the body. The tailgate 60 can be released from the lower pivot axis 144 by releasing the lower pins 150 and pivoted about the upper pivot axis 140 when dumping is desired. If desired, the tailgate 60 may also be removed from the rear end 34 of the body 24.

Referring to FIGS. 1 and 2, a rear exposed portion 160 is provided, which includes an asphalt lip 162 that extends generally substantially horizontally rearward and below the tailgate 60 and a portion of the endless conveyor 52 that projects out beyond the rear end 34 of the body 24 and beyond the tailgate 60. Advantageously, the lip 162 extends at least six inches rearward of the body, preferably at least about 12 inches, and most preferably at least about 18 inches. It is further preferred that the asphalt lip 162 extend rearward to at least the same extent as the endless conveyor 52.

Figure 4:
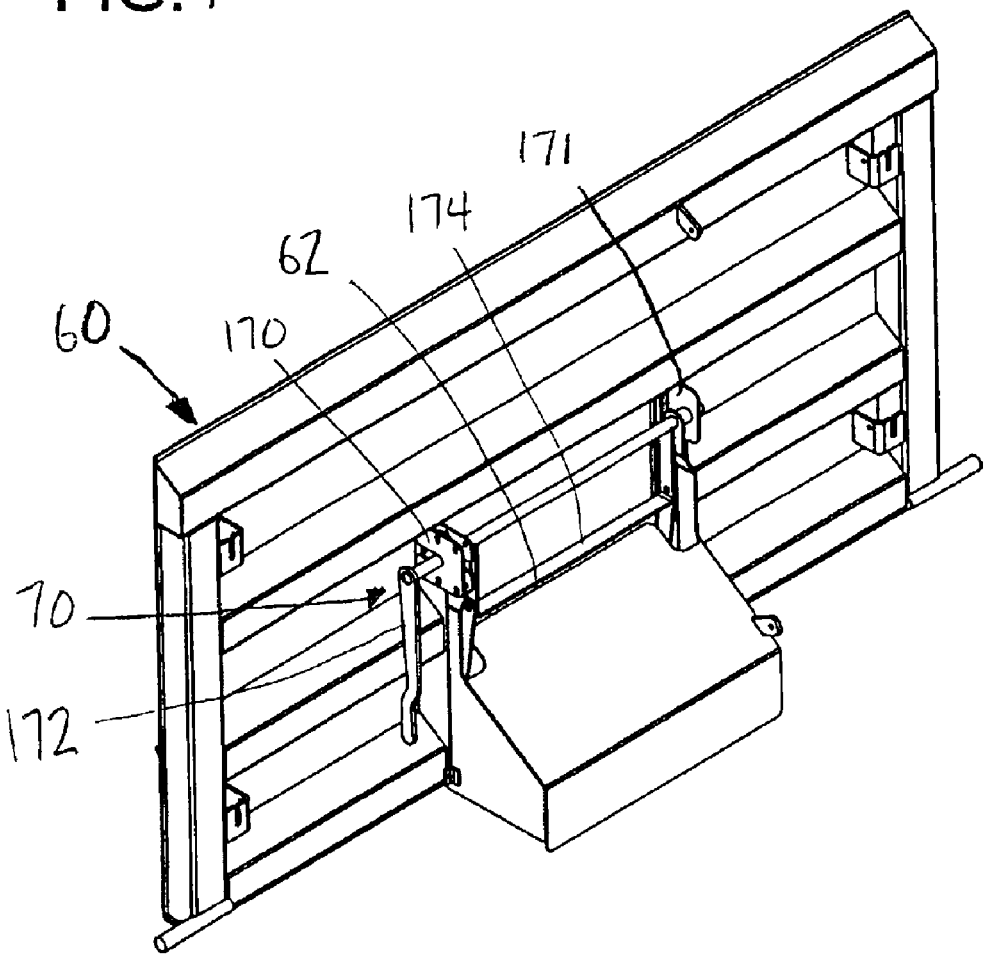
FIG. 4 is a perspective view of a tailgate, a feed gate assembly, and a cover assembly of the vehicle of FIG. 1.
Figure 6:
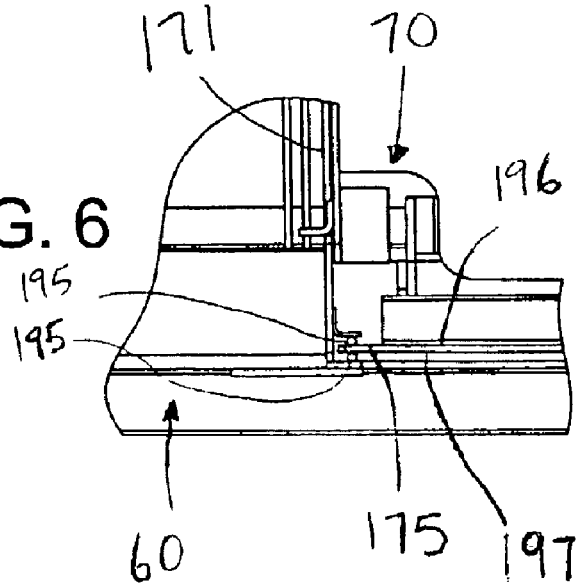
FIG. 6 is an enlarged fragmentary top plan view of the feed gate assembly of FIG. 4.
Figure 5:
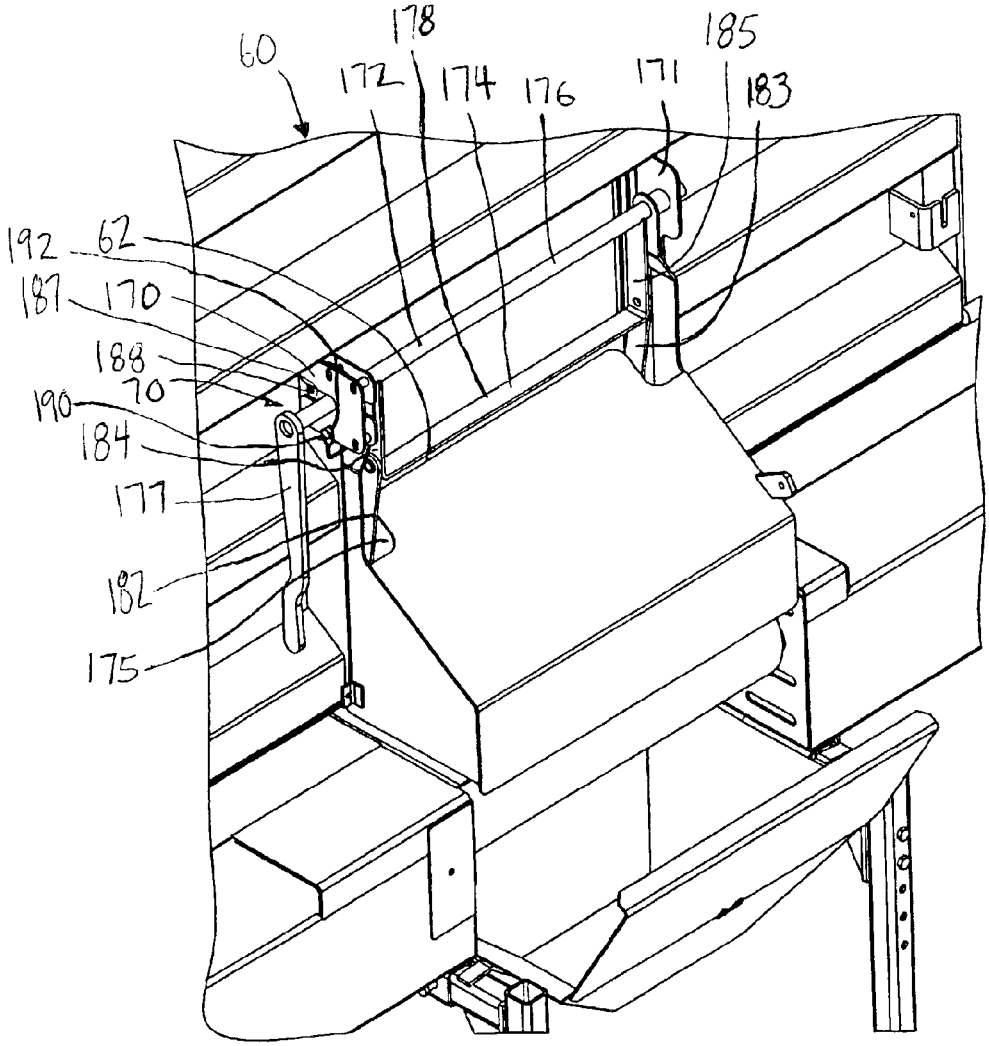
FIG. 5 is an enlarged fragmentary perspective view of the feed gate assembly of FIG. 4.

Referring to FIGS. 4–6, the rear feed gate assembly 70 is provided to selectively cover the opening 62 of the tailgate 60. The feed gate assembly 70 includes first and second support members 170, 171 mounted to the tailgate 60, a handle 172 rotatably mounted to the first and second support members 170, 171, a bailment 174 depending from the handle 172, and a cover plate 175 pivotally mounted to the bailment 174. The cover plate 175 is slidably mounted to the tailgate 60 to selectively cover the opening 62. The cover plate 175 is movable between a closed position and a range of open positions. The handle 172 positions the cover plate 175.

Referring to FIG. 5, the first and second support members 170, 171 are in spaced relation to each other and flank the opening 62 of the tailgate 60. The support members 170, 171 support the handle 172 such that the handle 172 can rotate. The handle 172 includes a shaft 176 and a gripping portion 177 depending therefrom. The handle 172 is cooperatively arranged with the bailment 174 to selectively move the bailment 174.

The bailment 174 includes a frame 178 and depending first and second pivotable links 182, 183. The frame 178 is generally U-shaped and is mounted to the shaft 176. The links 182, 183 are pivotally mounted to the frame 178 and to the cover plate 175.

The frame 178 includes first and second arms 184, 185 "in close proximity" to the first and second support members 170, 171, respectively. "In close proximity" means that the arm and the support member are within about two inches of each other, preferably within one inch of each other. The arm and the support member can be disposed with respect to each other such that the shaft does not deflect more than a predetermined value in operation. The close proximity of the arms 184, 185 to the support members 170, 171 places the load on the shaft 176 adjacent to the support members, 170, 171, thereby reducing the tendency of the shaft 176 to bend when opening or closing the cover plate 175.

Figure 11:
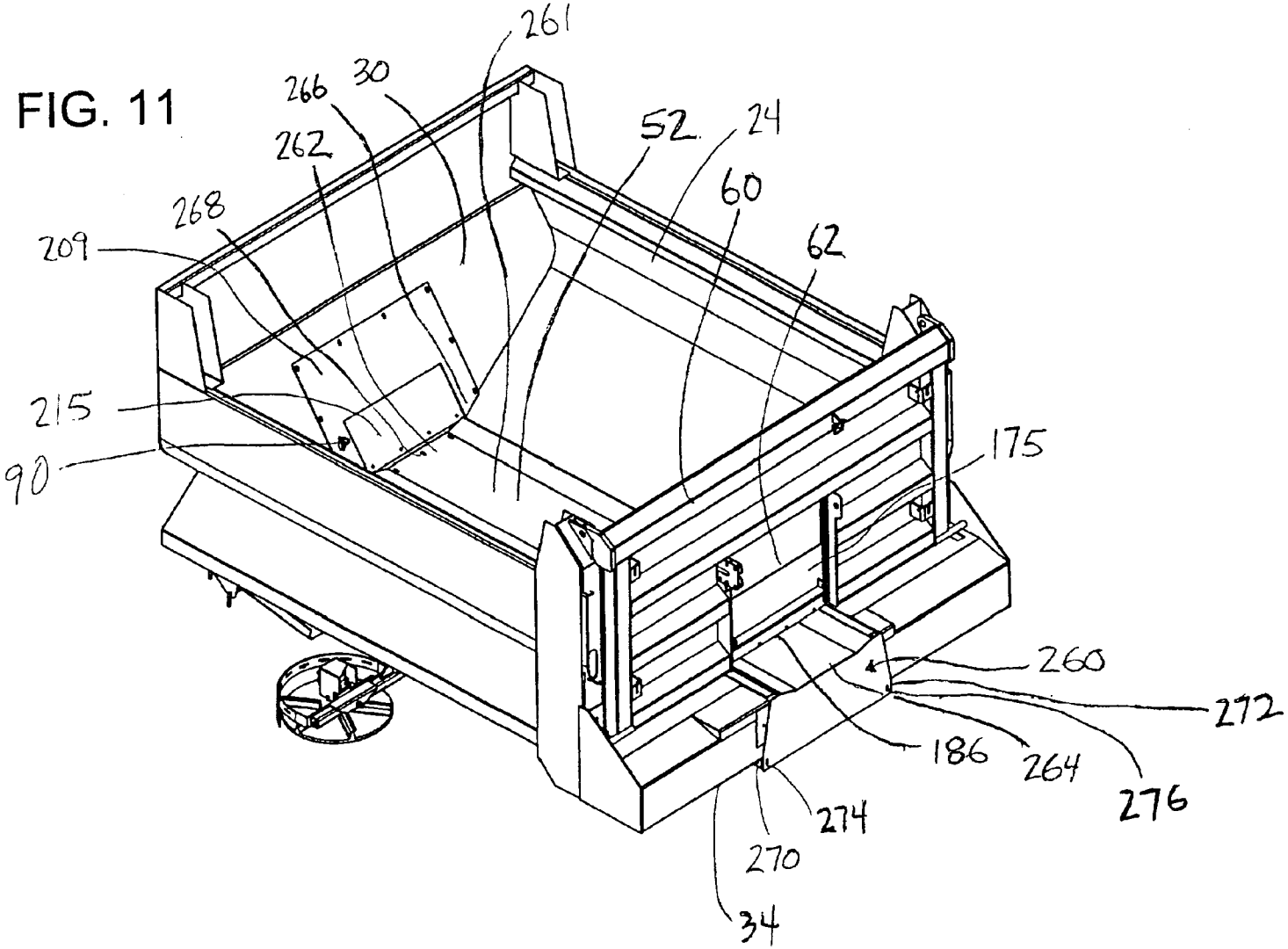
FIG. 11 is a perspective view generally from the rear and the first side of a body including a conveyor cover assembly.

Referring to FIG. 11, in the closed position, the plate 175 covers the opening 62 wherein a bottom edge 186 of the plate 175 rests on or is disposed just above the endless conveyor 52. The cover plate 175 can be moved to any of the range of open positions to control the size of the opening 62 in the tailgate 60. The cover plate 175 is adjustable to meter the flow of material through the opening 62 of the tailgate 60.

Referring to FIG. 5, in operation, the handle 172 can be moved by operating the gripping portion 177, which in turn rotates the frame 178. The frame 178 acts upon the links 182, 183 which pivot with respect to the frame 178 and raise and lower the cover plate 175 according to the movement of the handle 172.

An indexing member in the form of a circular indexing plate 189 is cooperatively arranged with the first support member 170 and the shaft 176 to provide a retaining mechanism for holding the handle 172, and thereby the cover plate 175, in a selected position. The indexing plate 187 is mounted to the shaft 176 of the handle 172. The indexing plate 187 includes a plurality of holes 188 which provide incremental adjustment of the handle 172. A pin 190 can extend through a bore 192 in the first support member 170 and a selected one of the holes 188 in the indexing plate 189 to retain the handle 172, and consequently the cover plate 175, in the selected position.

Referring to FIG. 6, the feed gate assembly 70 further includes a plurality of guide members 195 which guide the cover plate 175 during movement thereof relative to the guide members 195. The guide members 195 are mounted to the tailgate 60. The cover plate 175 includes first and second surfaces 196, 197. It is preferred that at least one guide member 195 is disposed on the first surface 196 of the cover plate 175 and at least one guide member 195 is disposed on the second surface 197 of the cover plate 175. The illustrative feed gate assembly 70 includes four guide members 195 in spaced relation to each other such that the cover plate 175 fits between the guide members 195. Two of the guide members 195 are disposed adjacent the first support member to guide the cover plate 175 from the first and second surfaces 196, 197 thereof. The other two guide members 195 are disposed adjacent the second support member 171 to guide the cover plate 175 from, respectively, first and second surfaces 196, 197 thereof.

Each guide member 195 is mounted to the tailgate 60. The illustrative guide members 195 each comprise a rod having a diameter of about ¼ inch and a length substantially equal to the height of the cover plate 175. The guide members 195 each include a curved contact surface which engages the cover plate 175. The configuration of the guide members reduces the amount of surface contact between the guide members and the cover plate 175, therefore reducing the amount of friction. By using rods, the chance for granular material to become lodged between the flat surface of the cover plate 175 and the guide members it rides on is greatly reduced.

Figure 7:
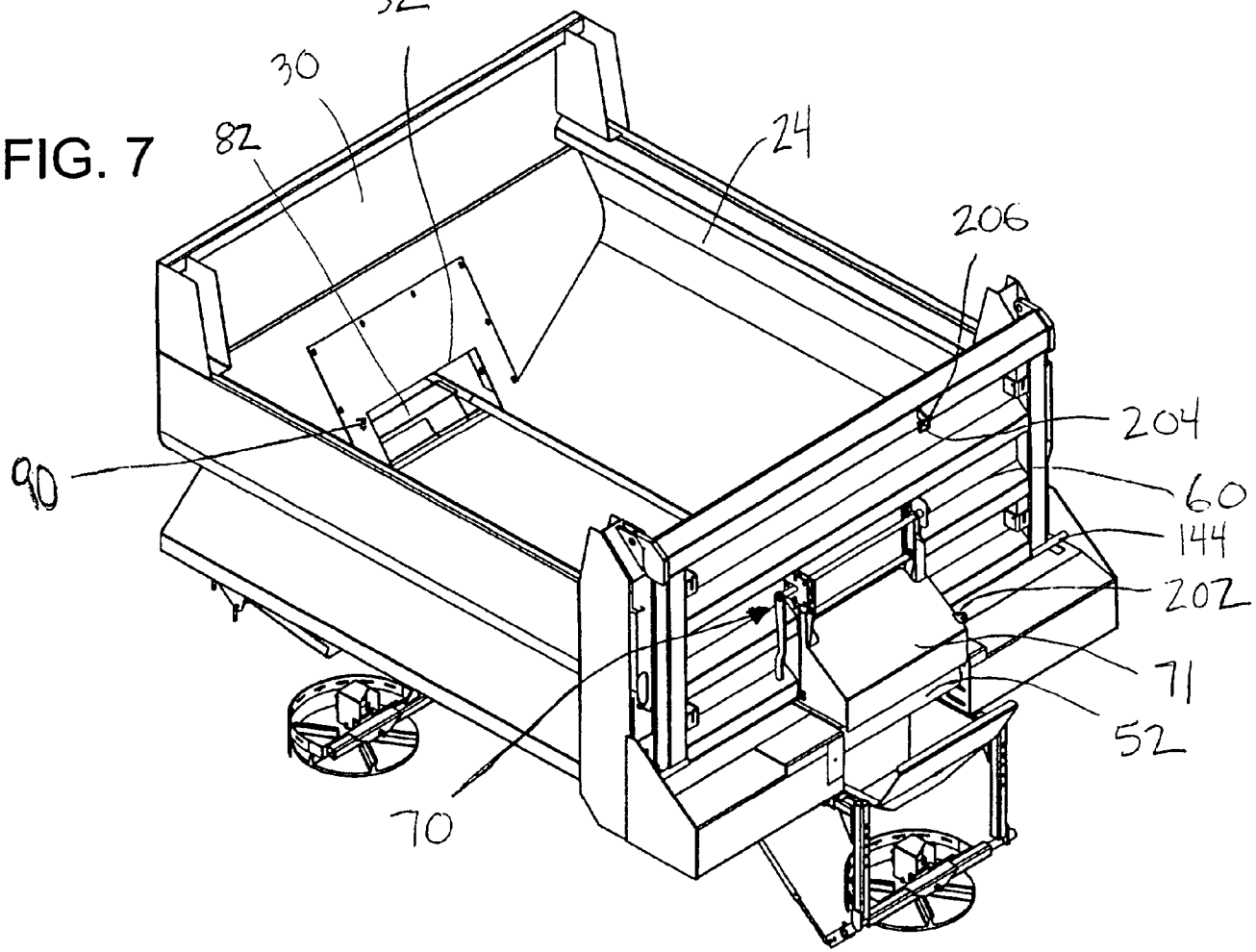
FIG. 7 is a perspective view of the body of FIG. 1 generally from the rear and the first side.

Referring to FIG. 7, the tailgate cover 71 can be pivoted from a down position to an elevated position. The cover 71 includes a tab 202 for latching the cover in the elevated position to an ear 204 of the tailgate 60 by a pin and hole mechanism 206. In the down position, shown in FIG. 7, the cover 71 is generally held in place by gravity but could also be latched in place if desired.

When in the down position, the cover 71 prevents someone from stepping on the endless conveyor 52, which can be moving, and is allowed to float when material is conveyed out the rear, thereby creating little or no flow restriction.

The rotational capability of the cover 71 allows the operator to pivot the tailgate 60 about the lower pivot axis 144 without the cover 71 interfering. The cover 71 can be rotated to the elevated position and retained therein out of the way such that the tailgate 60 can be readily pivoted about the lower pivot axis 144 from the closed position to an open position without interference between the cover 71 and the endless conveyor 52. During movement of the tailgate 60, the cover 71 can pivot out of the way of the endless conveyor 52.

The front feed gate assembly 90 is provided at a panel 209 of the front end 30 of the body 24 to selectively cover the opening 32 therein to provide a degree of control over the expulsion of material from the front of the body 24 and onto the cross conveyor 82. The front feed gate assembly 90 is of similar function and construction as the rear feed gate assembly 70.

Figure 8:
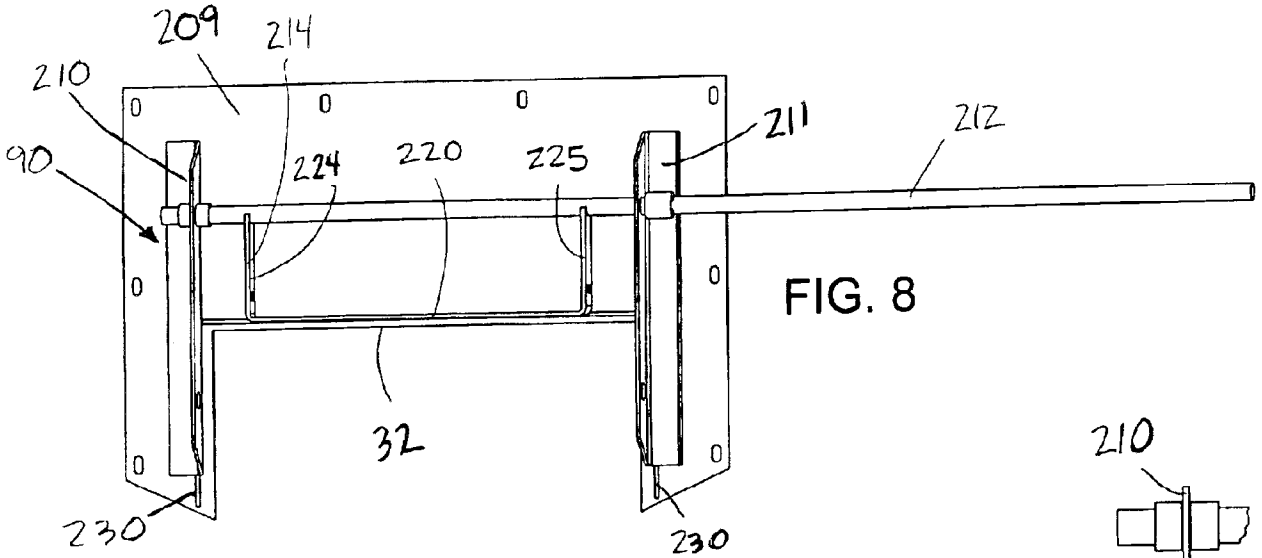
FIG. 8 is a front end elevational view of a portion of a front feed gate assembly of the vehicle of FIG. 1.

Referring to FIGS. 8 and 11, the front feed gate assembly 90 includes first and second support members 210, 211 mounted to the panel 209 of the front end 30 of the body 24, a handle 212 rotatably mounted to the first and second support members 210, 211, a bailment 214 depending from the handle 212, and a cover plate 215 pivotally mounted to the bailment 214. The cover plate 215 is slidably mounted with respect to the front end 30 to selectively cover the opening 32. The cover plate 215 is movable between a closed position and a range of open positions. The handle 212 positions the cover plate 215.

The bailment 214 is similar to the bailment of the rear feed gate assembly and includes a frame 220 and first and second pivotable links. The frame 220 of the bailment 214 has first and second arms 224, 225 "in close proximity" to the first and second support members, respectively. "In close proximity" means . . . .

Figure 9:
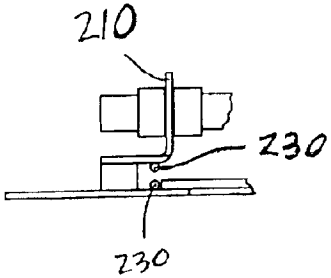
FIG. 9 is an enlarged fragmentary top plan view of the front feed gate assembly of FIG. 8.

Referring to FIGS. 8 and 9, the front feed gate assembly 90 includes guide members 230 similar in construction and function to those guide members described herein with respect to the rear feed gate assembly. In the illustrative embodiment, two guide members 230 are mounted to the front panel 209 adjacent the first and second support members 210, 211, respectively. Two other guide members 230 are mounted to the first and second support members 210, 211, respectively to establish a cooperating pair of guide members 230 adjacent each of the first and second support members 210, 211.

Figure 10:
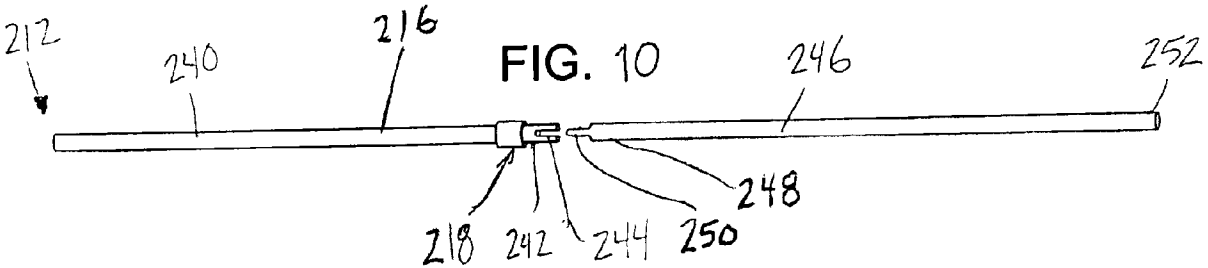
FIG. 10 is an exploded view of a handle of the front feed gate assembly of FIG. 8

Referring to FIGS. 9 and 10, the handle 212 includes a shaft 216 having a coupling 218 for a slot and tang arrangement. The shaft 216 includes a first rod 240 having an end 242 with a slot 244 and a second rod 246 having a first end 248 with a tang 250 and a second end 252. The slot 244 and the tang 250 provide for the mounting of the first and second rods 240, 246 to each other. The "slot and tang" arrangement provides strength to the coupling 218 that readily avoids problems with tolerances and fit during manufacture as well as with field repairs and replacements. To allow the operator to use the handle 212, the second end 252 of the second rod 246 extends beyond one of the first and second side walls of the body. The front feed gate assembly 90 is similar in other respects to the rear feed gate assembly 70 shown and described herein.

Referring to FIG. 11, a conveyor cover assembly 260 can be provided that includes a cover 261 configured to completely cover the endless conveyor 52 along the length thereof. The cover 261 includes a front end 262 and a rear end 264. The front end 262 of the cover 261 is removably mounted to a front knee brace 266 of the front end 30 of the body 24 with a bracket 268, for example, that is bolted to the cover 261 and the knee brace 266. The rear end 260 of the cover extends rearwardly from the tailgate 60.

Mounting members 270, 272 are secured to the body 24 adjacent the rear end 264 of the cover 261. The illustrative mounting members 270, 272 are a pair of mounting tubes mounted to the body 24 at the rear end 34 of the body 24. The rear end 264 of the cover 261 includes a pair of tabs 274, 276 which is respectively removably mounted to the pair of mounting members 270, 272. The rear end 264 is secured with the tabs 274, 276 which are respectively inserted into the pair of mounting tubes 270, 272.

The cover 261 is configured to completely cover the endless conveyor 52 along the length thereof. With the front end 262 and the rear end 264 being removably mounted to the body 24, the cover 261 is easily removable. On the other hand, the cover 261 is mounted such that it is prevented from shifting around or detaching when the body 24 is in a dumping position.

The conveyor cover assembly 260 is particularly advantageous when the body 24 is used as a dumping body for extended periods of time. The operator can load the body 24 with materials, such as, large rocks or boulders, or broken sections of concrete containing steel reinforcement bar, for example. The cover assembly 260 protects the endless conveyor from damage that it might otherwise sustain from such materials.

Figure 12:
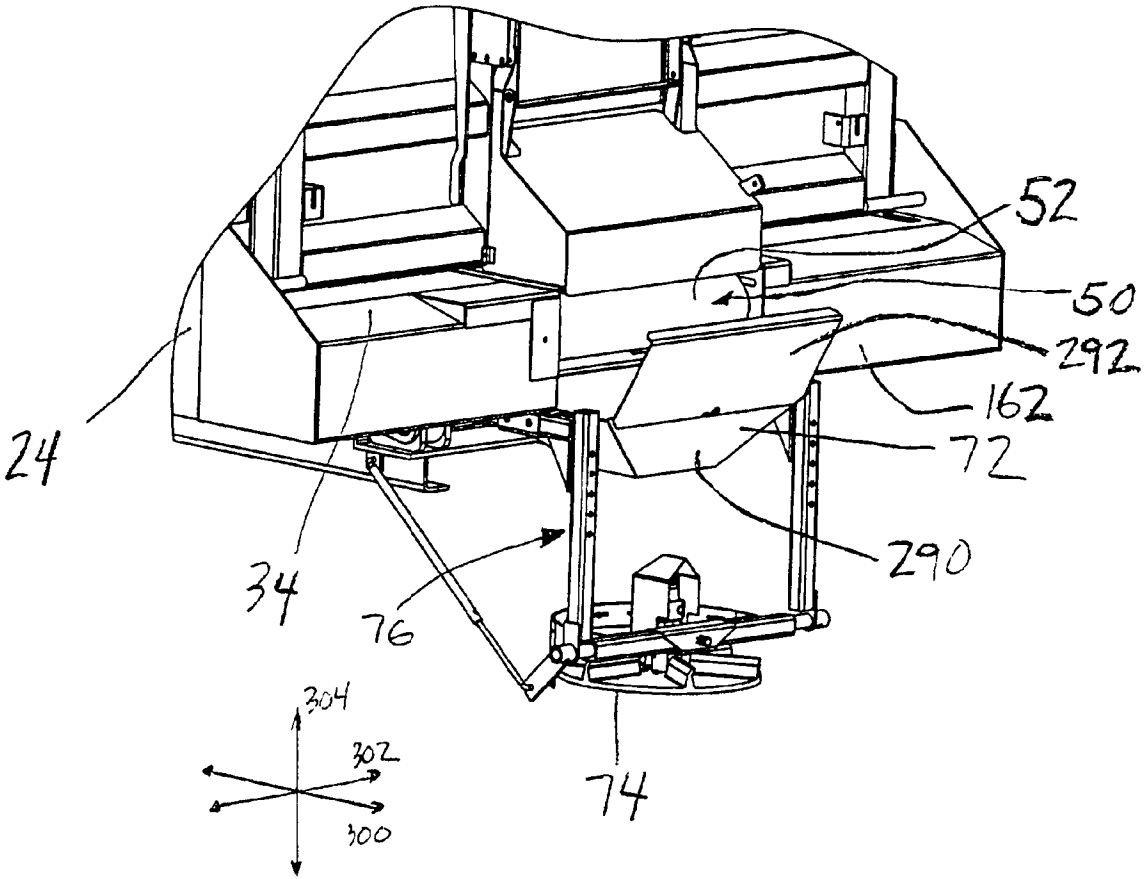
FIG. 12 is an enlarged fragmentary rear end perspective view of the vehicle of FIG. 1.

Referring to FIG. 12, the rear diverter chute 72 is operably arranged with the conveyor assembly 50 to receive materials from the endless conveyor 52 of the conveyor assembly 50. The rear spreader 74 is operably arranged with the rear diverter chute 72 to selectively receive materials from the chute 72. The diverter chute 72 is mounted to the asphalt lip 162 adjacent the rear end 34 of the body 24. In other embodiments, the diverter chute 72 can be mounted to one of the first and second side walls of the body 24 to cooperate with a side spreader.

Figure 13:
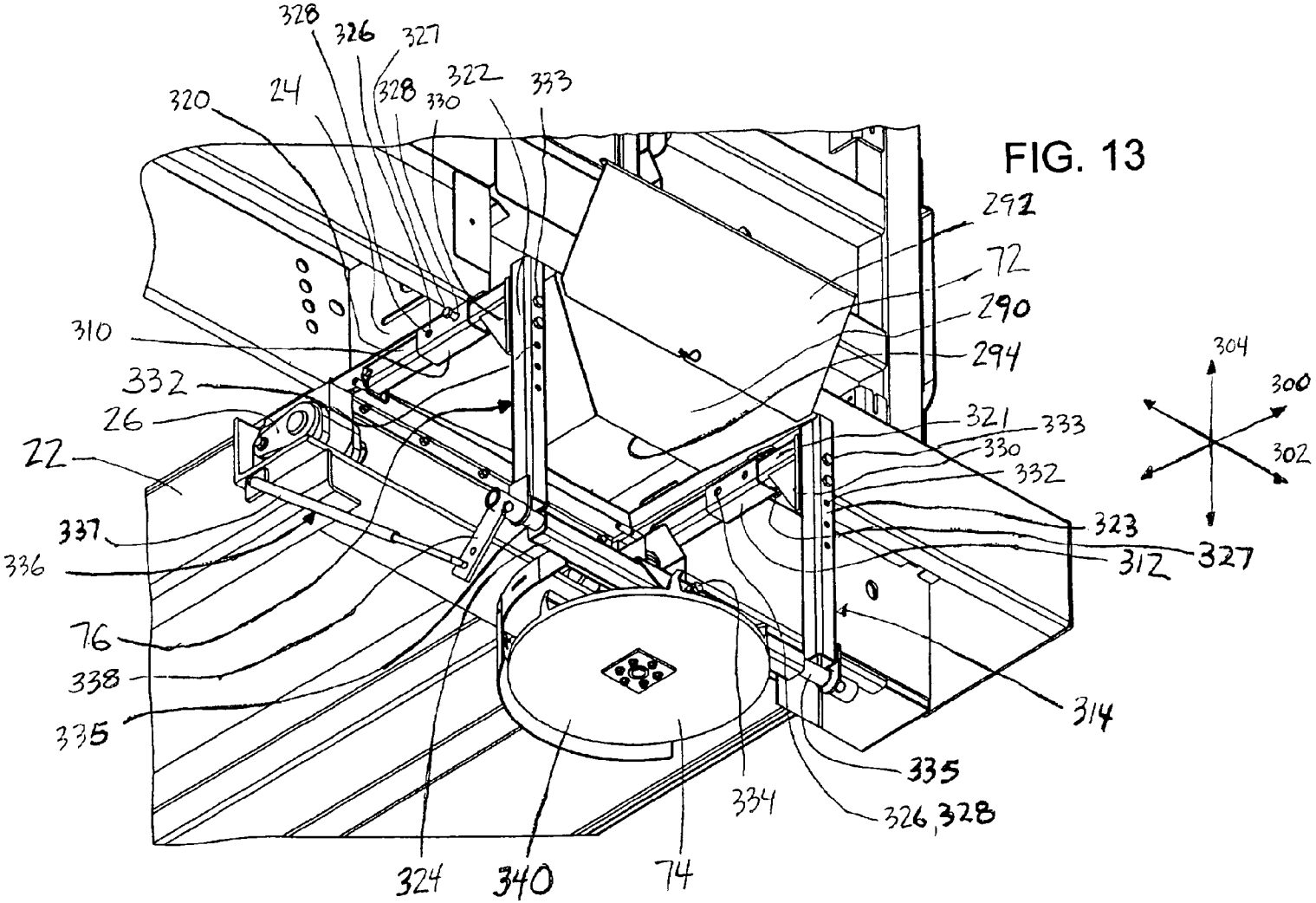
FIG. 13 is an enlarged fragmentary perspective view from the bottom and the rear of the vehicle of FIG. 1.

Referring to FIGS. 12 and 13, the rear chute 72 includes a body 290 and a panel 292. The body 290 defines a passageway 294. The panel 292 is configured to direct selectively material from the endless conveyor 52 through the passageway 294. The panel 292 of the diverter chute 72 is movable between an open position, as shown in FIG. 12, and a closed position. The panel 292 allows materials to move through the chute 72 to the spreader 74 when the panel 292 is disposed in the first position, i.e., the open position. The panel 292 helps direct material that is being conveyed from the conveyor assembly 50 from the body 24. The panel 292 prevents materials from moving through the diverter 72 to the spreader 74 when the panel 292 is disposed in the second position, i.e., the closed position. When the panel 292 is in the closed position, it is possible to dump material out of the body 24 and still protect the spreader 74. This protection feature is very beneficial when stock-piling material after finished spreading because the spreader 74 and the chute 72 need not be removed before dumping materials from the body 24.

Referring to FIG. 12, the rear spreader 74 is adjustably mounted to the vehicle 20 and cooperatively arranged with the endless conveyor 52 of the conveyor assembly 50 to receive and selectively spread materials. The spreader 74 is selectively movable along a first axis 300, a second axis 302, and a third axis 304. The three axes 300, 302, 304 are mutually perpendicular to each other. The first axis 300, the second axis 302, and the third axis 304 are a longitudinal axis, a transverse axis, and a vertical axis, respectively. The spreader 74 is adjustable along the first, second, and third axes 300, 302, 304 relative to the conveyor assembly 50 for assisting in the receipt of materials therefrom and for creating a desired spread pattern.

The spreader mounting assembly 76 mounts the spreader 74 to the body 24. The first spreader mounting assembly 76 can be provided to allow the rear spreader 74 to have three degrees of adjustment, namely along the longitudinal axis 300, the transverse axis 302, and the vertical axis 304. The spreader mounting assembly 76 is mounted to the body 24. The spreader 74 is adjustably mounted to the spreader mounting assembly 76.

Referring to FIG. 13, the spreader mounting assembly 76 includes a pair of support members 310, 312 and an adjustment mechanism 314. The support members 310, 312 are secured to the body 24. The adjustment mechanism 314 is secured to the support members 310, 312. The adjustment mechanism 314 allows the spreader 74 to selectively move along the first, second, and third axes 300, 302, 304.

The adjustment mechanism 314 includes a pair of first adjustment members 320, 321, a pair of second adjustment members 322, 323, and a third adjustment member 324. The first adjustment members 320, 321 are respectively movably mounted to the support members 310, 311 inch that the first adjustment members 320, 321 are selectively movable along the first axis, the longitudinal axis 300. The second adjustment members 322, 323 are respectively movably mounted to the first adjustment members 320, 321 such that the second adjustment members 322, 323 are selectively movable along the second axis, the transverse axis 302. The third adjustment member 324 is mounted to the second adjustment members 322, 323. The spreader 74 is adjustably mounted to the third adjustment member 324 such that the spreader 74 is selectively movable along the third axis, the vertical axis 304.

Fore and aft adjustment along the longitudinal axis 300 is achieved by moving the longitudinal adjustment members 320, 321 along the longitudinal axis 300 in and out, respectively, of the support members 310, 311. The longitudinal adjustment members 320, 321 each include a plurality of holes 326 in spaced relation to each other. The spacing of the holes 326 allows for incremental adjustment of the longitudinal adjustment members 320, 321, for example, in 1-inch increments. The longitudinal adjustment members 320, 321 can be mounted to the support members 310, 311 with bolts 327, for example, by aligning a selected pair of holes 326 of the each longitudinal adjustment member 320, 321 with a pair of holes 328 in each support member 310, 311, respectively.

Vertical adjustment along the vertical axis 304 can be achieved by bolting, for example, the vertical adjustment members 322, 323 to a respective bracket 330 at the distal end of each first adjustment members 320, 321. The vertical adjustment members 322, 323 each include a plurality of holes 332 in spaced relationship to each other. The spacing of the holes 332 allows for incremental adjustment of the vertical adjustment members 322, 323, for example, in 1-inch increments. The vertical adjustment members 322, 323 can be mounted to the longitudinal adjustment members 320, 321 with bolts 333, for example, by aligning a selected pair of holes 332 of the each vertical adjustment members 322, 323 with a pair of boles in each bracket 330 of the longitudinal adjustment members 320, 321, respectively. The spreader 74 can be incrementally movable along at least one of the first, second, and third axes 300, 302, 304.

Side to side adjustment along the transverse axis 302 is achieved by sliding the spreader 74 along the transverse adjustment member 324 that extends between the second adjustment members 322, 323. The spreader 74 can be selectively secured in place to prevent for the further side-to-side movement by a setscrew 334, for example.

Each second adjustment member 322, 323 includes a lug 335. The transverse adjustment member 324 is mounted to the lugs 335 of the second adjustment members 322, 323 and is free to pivot in the lugs 335 about the transverse axis 302. The spreader mounting assembly 76 can include a leveling mechanism 336 to prevent the spreader 74 from rotating. The illustrative leveling mechanism 336 includes a leveling rod 337 and a linkage 338. The linkage 338 is mounted to the third adjustment member 324 and pivotally mounted to the leveling rod 337. The leveling rod 337 is pivotally mounted to the chassis 22. The spreader 74, which is mounted to the third adjustment member 324, is kept from rotating by the leveling rod 337 attached to the truck chassis 22.

Figure 14:
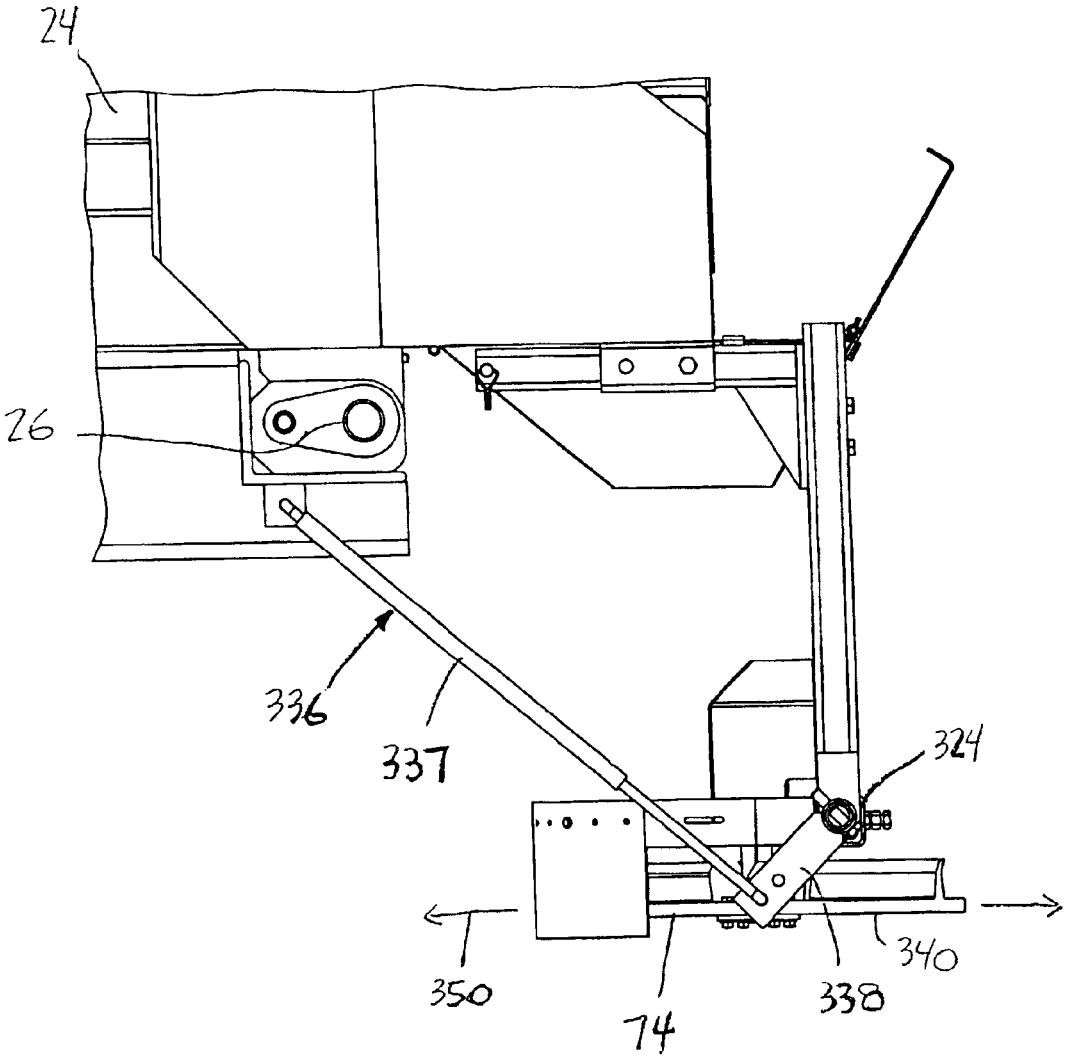
FIG. 14 is an enlarged fragmentary side elevational view of the vehicle of FIG. 1 showing the body in a normal position.
Figure 15:
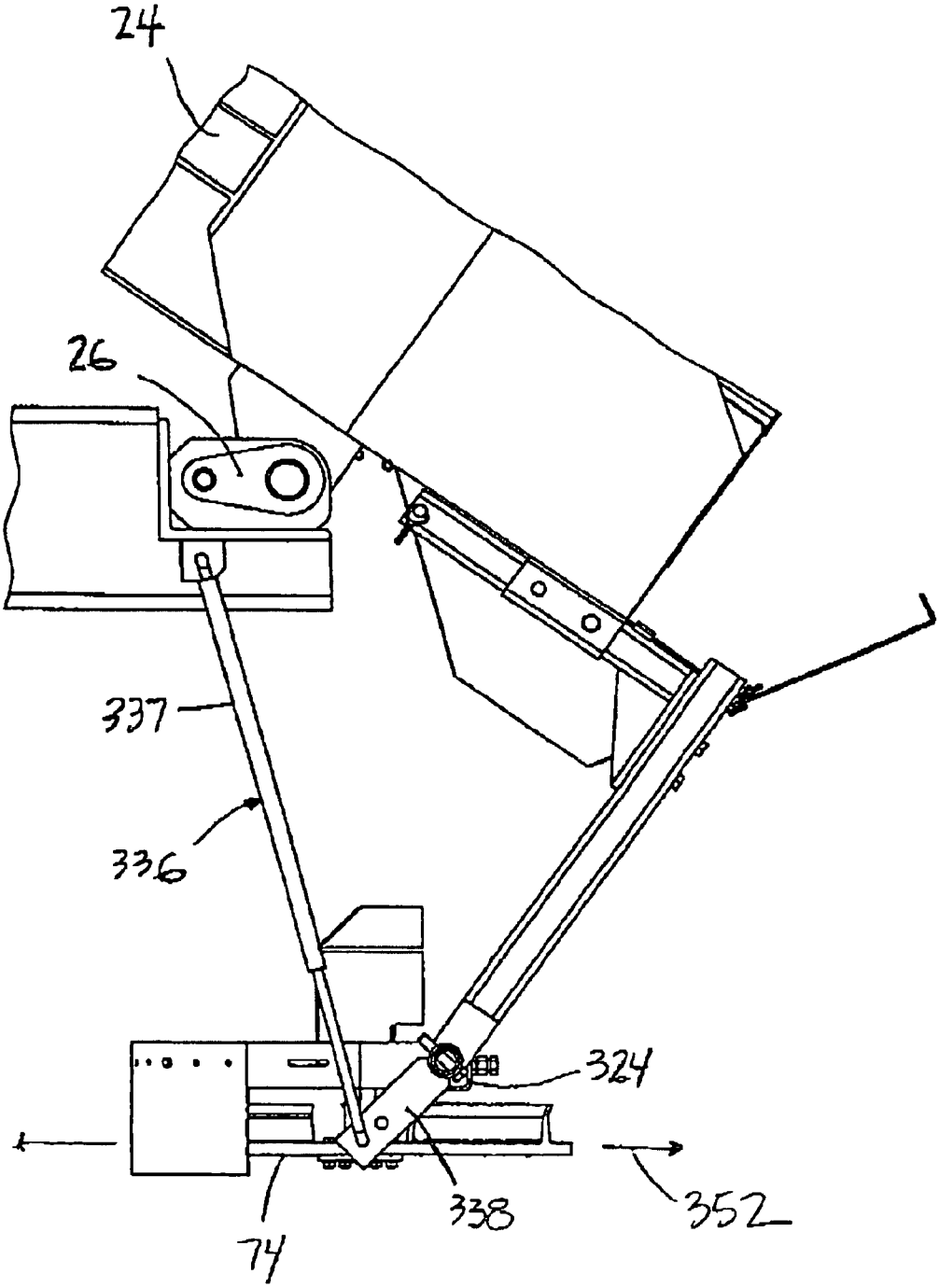
FIG. 15 is an enlarged fragmentary side elevational view of the vehicle of FIG. 1 showing the body in the inclined position.

Referring to FIGS. 14 and 15, the leveling mechanism 336 keeps the spreader 74 level over the range of travel of body 24 between the normal position and the fully inclined position. The hinge 26, the third adjustment member 324, the linkage 338, and the leveling rod 337 define a four-bar linkage system which maintains the spreader 74 in a substantially uniform orientation. Referring to FIG. 14, the body 24 is in the normal position. The spreader 74 includes a disk 340 which defines a first spreader plane 350 when the body 24 is in the normal position. Referring to FIG. 15, the body 24 is in the fully inclined position. The spreader 74 is pivotally mounted with respect to the body 24 by the spreader mounting assembly 76 such that when the body 24 is in the fully inclined position, the disk 340 defines a second spreader plane 352, which is substantially parallel to the first spreader plane 350. The first spreader plane 350 and the second spreader plane 352 are both substantially horizontal. The illustrative leveling mechanism 336 provides this leveling feature over the entire range of travel of the body 24 with the spreader plane remaining substantially horizontal at any selected position.

Figure 16:
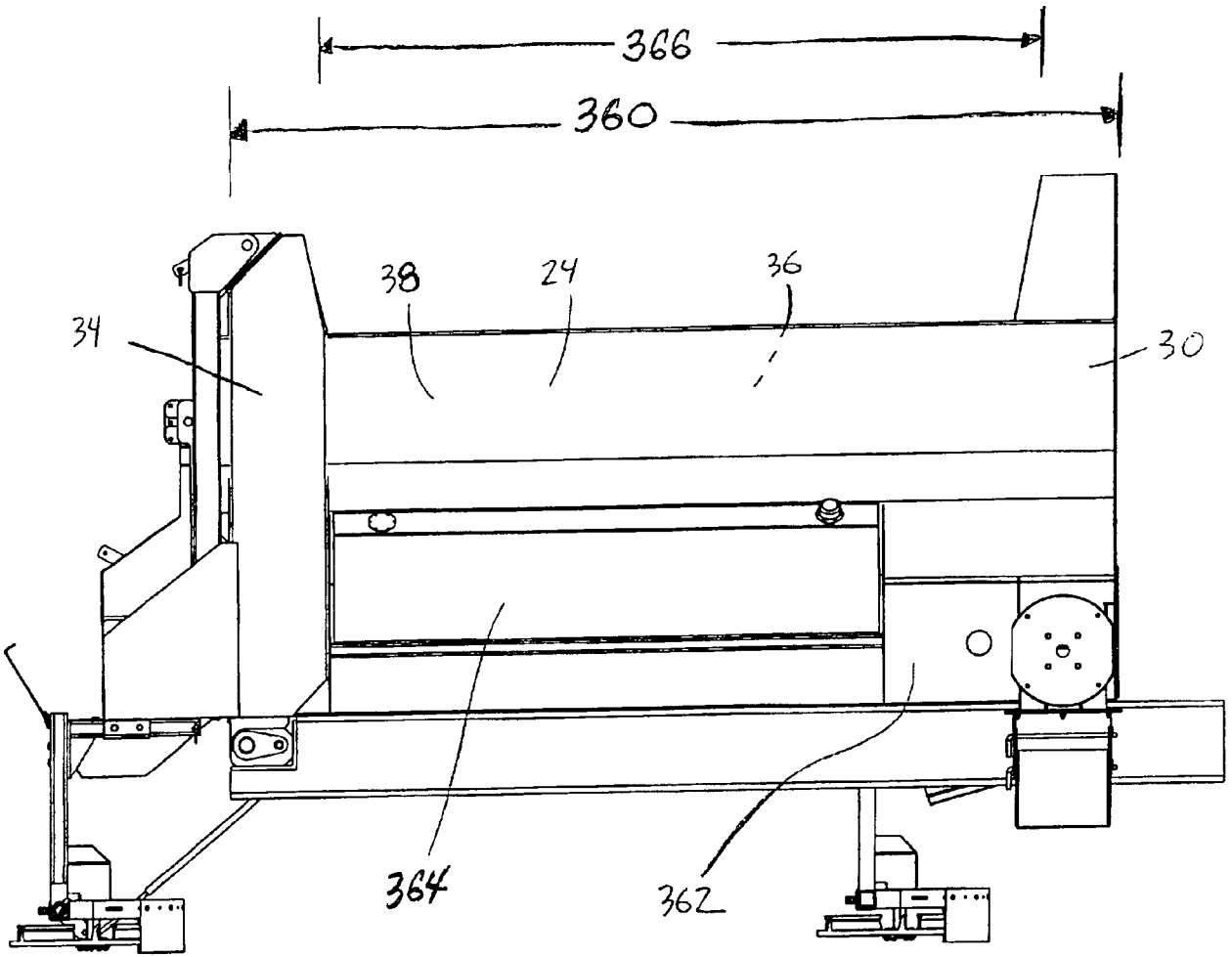
FIG. 16 is a second side elevational view of the body of FIG. 7.

Referring to FIG. 16, the front and rear ends 30, 34 of the body 24 define a body length 360. The second side wall 38 defines a recess 362. The first side wall 36 defines a similar recess. Each recess 362 is configured to accommodate a storage tank 364. Each recess 362 has a recess length 366 at least over fifty percent of the body length 360. In some embodiments, the recess length 366 can be as large as about the difference of the body length 360 subtracted by about two feet. The illustrative storage tank 360 is a tank for holding pre-wetting liquid. The recess 362 is configured such that it can accommodate the storage tank 360 wherein more of the liquid in the tank 360 is stored below the vertical midpoint of the side walls 36, 38, and preferably below the center of mass of the body 24.

Figure 17:
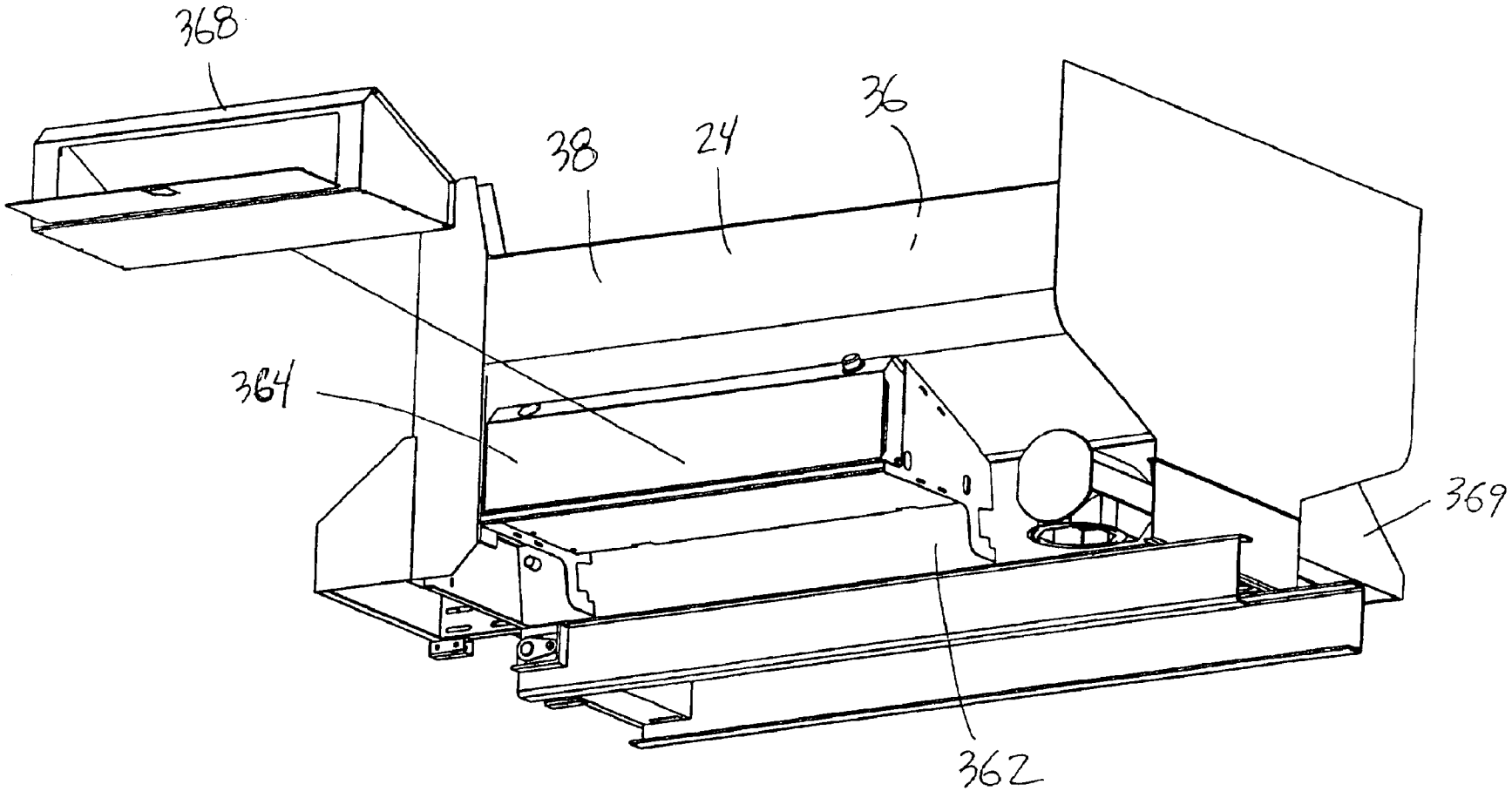
FIG. 17 is a perspective view from the second side of the body of FIG. 7 showing a tool box that is interchangeable with a storage tank.
Figure 18:
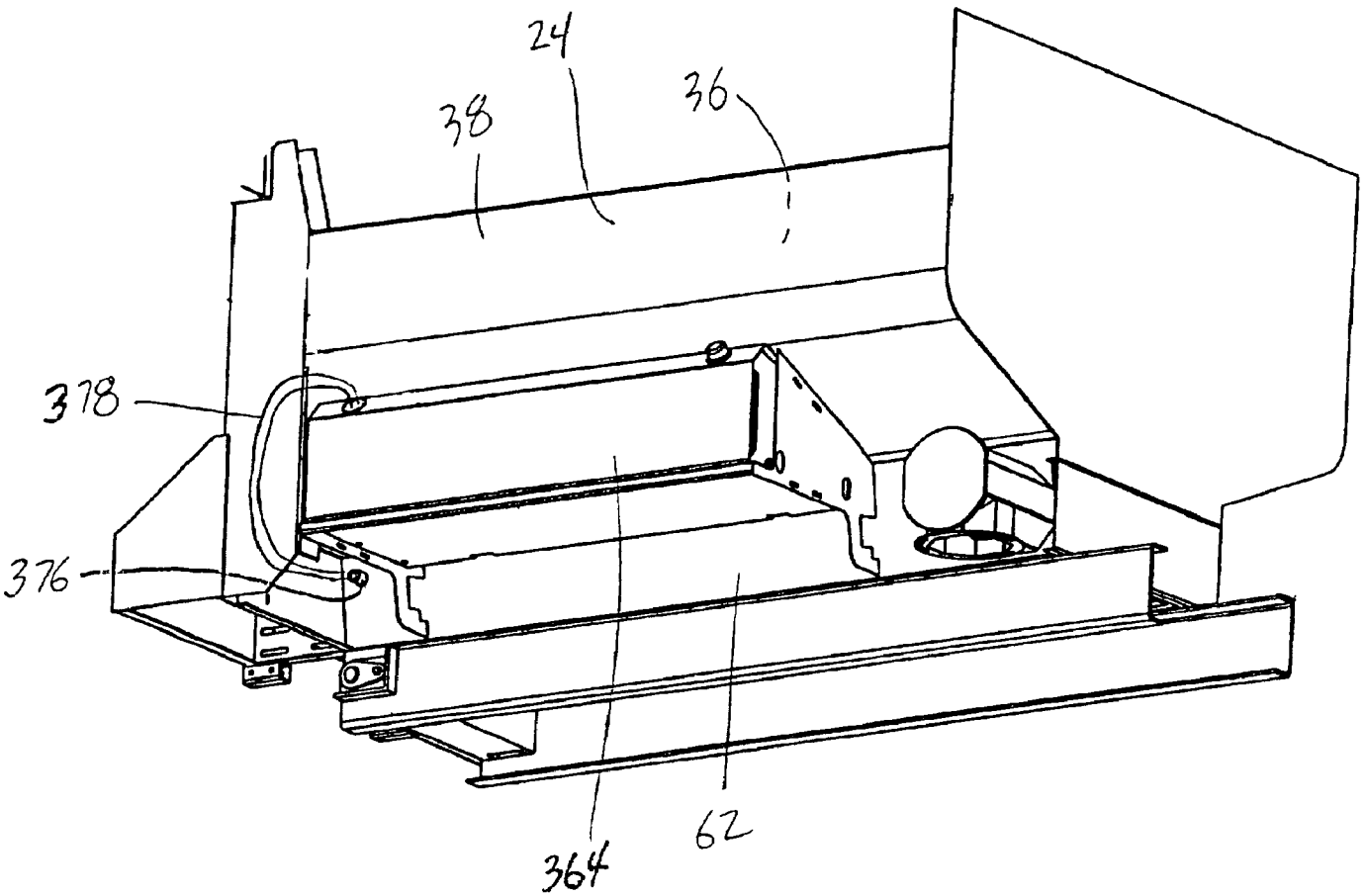
FIG. 18 is a perspective view from a second side of a body showing a cross tube fluidly connected with a storage tank.

Referring to FIG. 17, the recess 362 of the second side wall 38 is configured to accommodate at least one of a storage box 368 and the storage tank 364. The illustrative storage box 364 is a toolbox. The tank 364 and the toolbox 368 are mounted the same way, thereby allowing them to be interchangeable. Either a single toolbox or a single tank can be provided. The first side wall has a sill 369 mounted to it, as shown in FIG. 18. The sill 369 covers the recess defined by the first side wall 36. The sill 369 can be removed and a toolbox or a tank can be mounted to the first side wall. In other embodiments a pair of toolboxes, a pair of tanks, or a single tank and a single toolbox can be mounted to the first and second side walls 36, 38, respectively.

Referring to FIG. 18, in embodiments of the vehicle where the recesses 62 of the side walls 36, 38 each accommodate the pre-wetting tank 364, a cross tube 376 can be provided to provide a convenient means for the tanks 364 to cooperate together. The cross tube 376 extends between the first and second side walls 36, 38 of the body 24. The cross tube 376 is configured to accommodate a balancing tube 378. The balancing tube 378 extends through the cross tube 376. The balancing tube 378 can be fluidly connected to the tanks 364 to assist in maintaining substantially equal amounts of pre-wetting liquid in the tanks 364. The balancing tube 378 can be disposed in the cross tube 376 to prevent the balancing tube 378 from being damaged. The cross tube 376 can also be used to conveniently house electrical wiring, for example.

Figure 19:
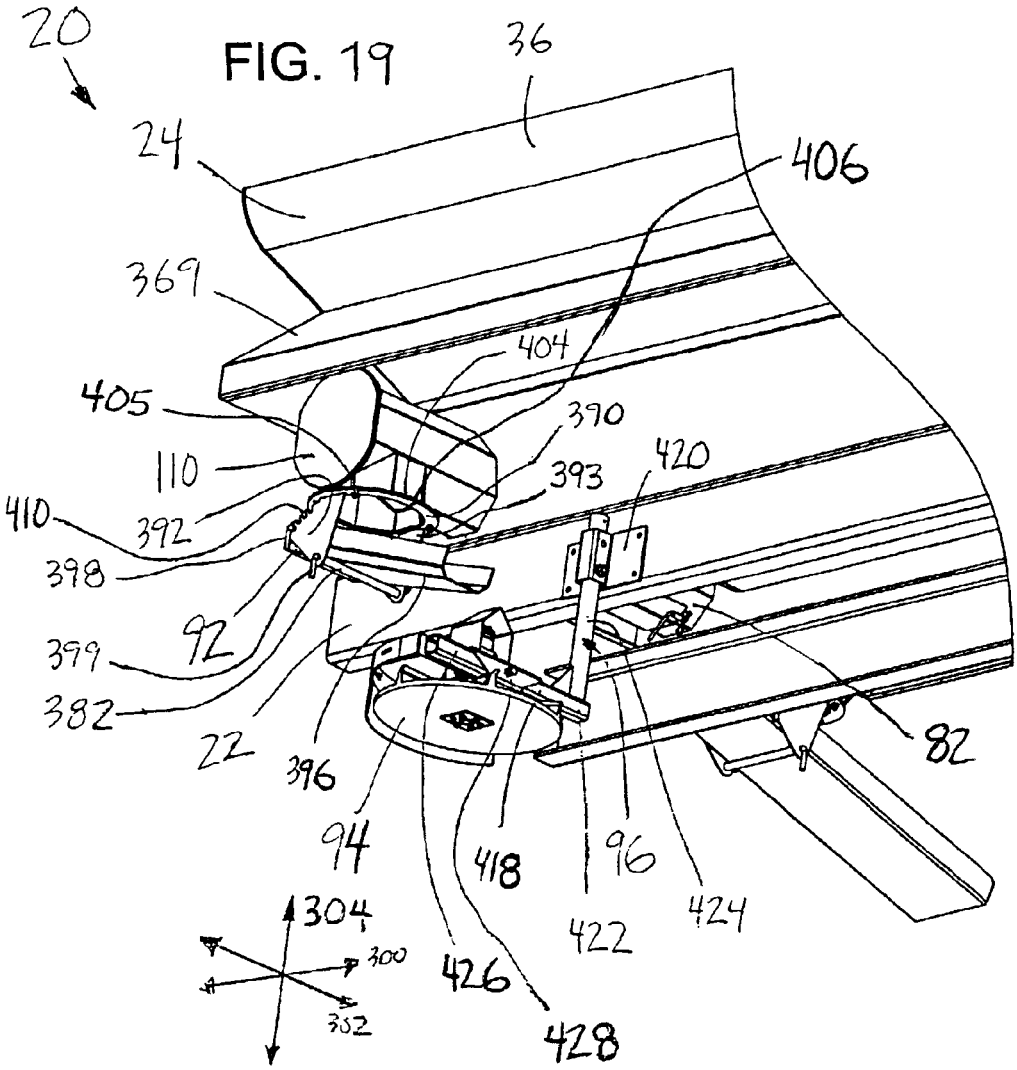
FIG. 19 is an enlarged fragmentary front end perspective view of the body of FIG. 7 generally from the bottom and the first side of the body.
Figure 20:
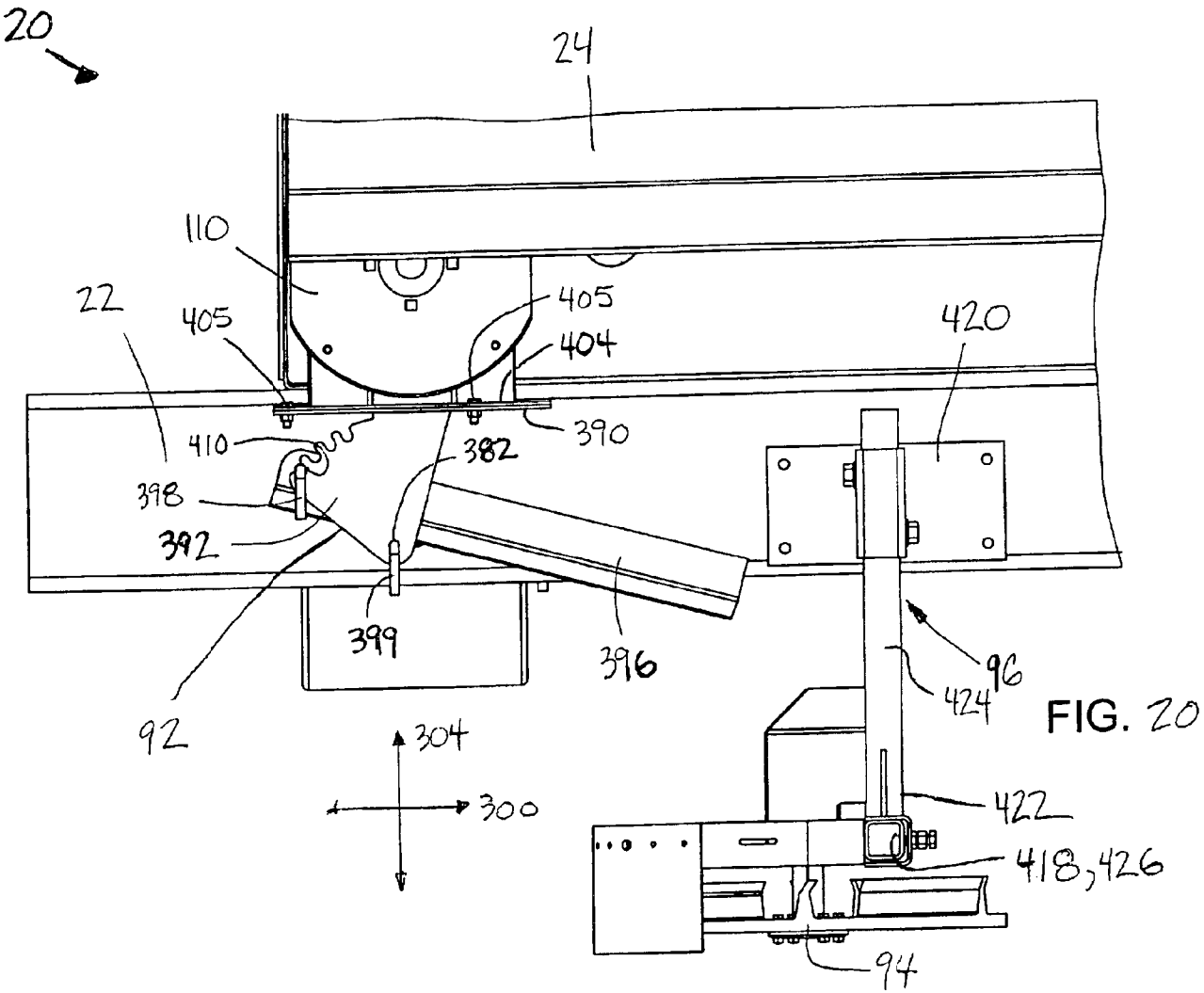
FIG. 20 is an enlarged fragmentary first side elevational view of the body of FIG. 7.

Referring to FIGS. 19 and 20, the first side chute 92 is pivotally mounted to the body 24, thereby reducing the items a vehicle dealer must mount to the chassis 22. The side chute 92 is rotatably mounted to the first discharge port 110. The chute 92 is operably arranged with the conveyor assembly to receive materials from the cross conveyor 82 and direct materials to the side spreader 94. The chute 92 is rotatable over a selected range of travel about the vertical axis 304 and a selected range of travel about a chute axis 382. The ability to rotate the chute allows the user to focus the material on the spreader to obtain a desired spread pattern. Preferably the vertical axis 304 and the chute axis 382 are generally perpendicular to each other.

The side chute 92 includes a mounting ring 390, first and second fins 392, 393 depending from the mounting ring 390, and a ramp 396 supported by first and second pins 398, 399 extending between the fins 392, 393. The mounting ring 390 is mounted to a mouth 404 of the first discharge port 110 by bolts 405, for example. The ring 390 includes a plurality of holes 406 to allow the ring 390 to be mounted to the mouth 404 of the port 110 in any of a plurality of mounting positions, thereby allowing the side chute 92 to be rotatable about the vertical axis 304. The illustrative range of travel over which the first chute 92 can rotate about the vertical axis 304 is defined by the interference of the first chute 92 with the chassis 22.

The illustrative side chute 92 is incrementally movable about the chute axis 382 over the selected range of travel. The chute axis 382 is defined by the second pin 399. Each fin 392, 394 includes a plurality of detents 410 in substantially uniform spaced relation to each other. To position the chute 92 relative to the chute axis 382, the first pin 398 can be disposed within a selected detent 410 in the first fin 392 and the aligning detent 410 in the second fin 393. The chute 92 can be moved about the chute axis 382 by selecting another pair of detents 410 and moving the first pin 398 thereto. The illustrative range of travel over which the first chute 92 can rotate about the chute axis 382 is defined by the location of the outermost detents 410 on the fins 392, 393. The spacing between adjacent detents 410 can be varied.

The second spreader mounting assembly 96 is provided to adjustably mount the side spreader 94 to the chassis 22 to provide three degrees of available adjustment allowing for the fine tuning of material application. In the illustrated embodiment of the vehicle 20, the spreader 94 is arranged to receive materials from the cross conveyor 82. The spreader 94 is adjustably mounted to the chassis 22 such that the spreader 94 is rotatable about, and movable along, the vertical axis 304 and is movable along a spreader axis 418.

The second spreader mounting assembly 96 includes a support member 420 and an arm 422. The support member 420 is mounted to the chassis 22. The support member 420 is configured to receive and support the arm 422. The illustrative arm 422 is L-shaped and includes a mounting portion 424 and a spreader portion 426. The mounting and spreader portions 424, 426 are substantially perpendicular to each other. The mounting portion 424 is substantially parallel to the vertical axis 304. The mounting portion 426 of the arm 422 is movably mounted to the support member 420, which is mounted to the chassis 22. The side spreader 94 is adjustably mounted to the spreader portion 426 of the arm 422. The arm 422 is rotatable about, and movable along, the vertical axis 304. The L-shaped arm 422 is able to pivot in the support member 420 to rotate the spreader 94 and is able to translate relative to the support member 420 to adjust the height of the spreader 94 vertically.

The spreader 94 is movably mounted to the spreader portion 426 of the arm 422 such that the spreader 94 can move along the spreader axis 418, which is defined by the spreader portion 426. The spreader 94 is able to move along the spreader portion 426 of the arm 422. The spreader 94 can be selectively secured in place to prevent further movement along the second axis 302 by a set screw 428, for example.

The ability of the second spreader mounting assembly 96 to adjust the position of the second spreader 94 along the spreader axis 418 and about the vertical axis 304 effectively allows the position of the second spreader 94 to be adjusted relative to the longitudinal axis 300 and the transverse axis 302. In conjunction with the ability to adjust the position of the second spreader 94 along the vertical axis 304, the second spreader mounting assembly 96 thereby provides three degrees of adjustment for the second spreader 94.

Figure 21:
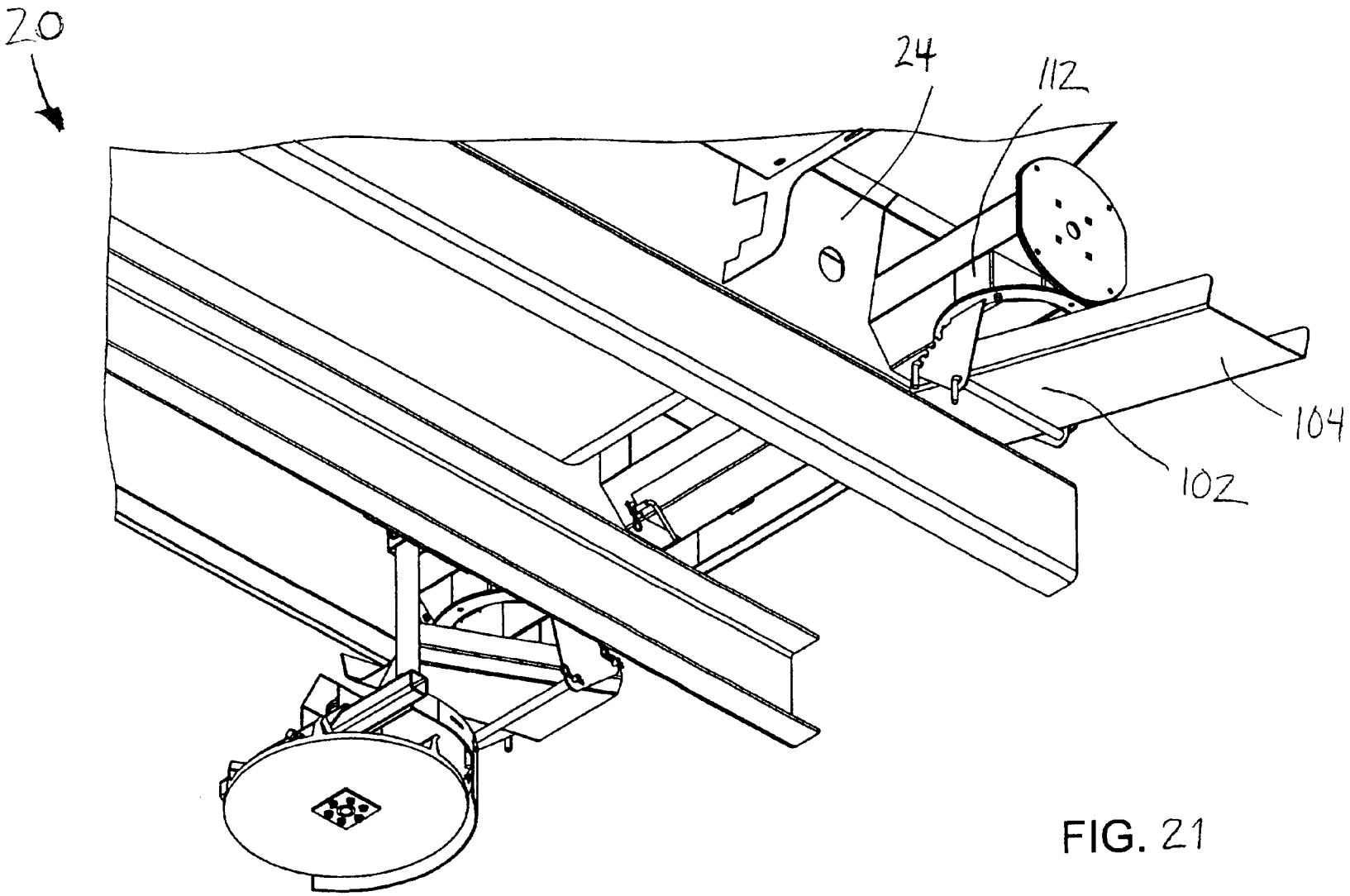
FIG. 21 is an enlarged fragmentary front end perspective view of the body of FIG. 7 generally from the bottom and the second side of the body.
Figure 22:
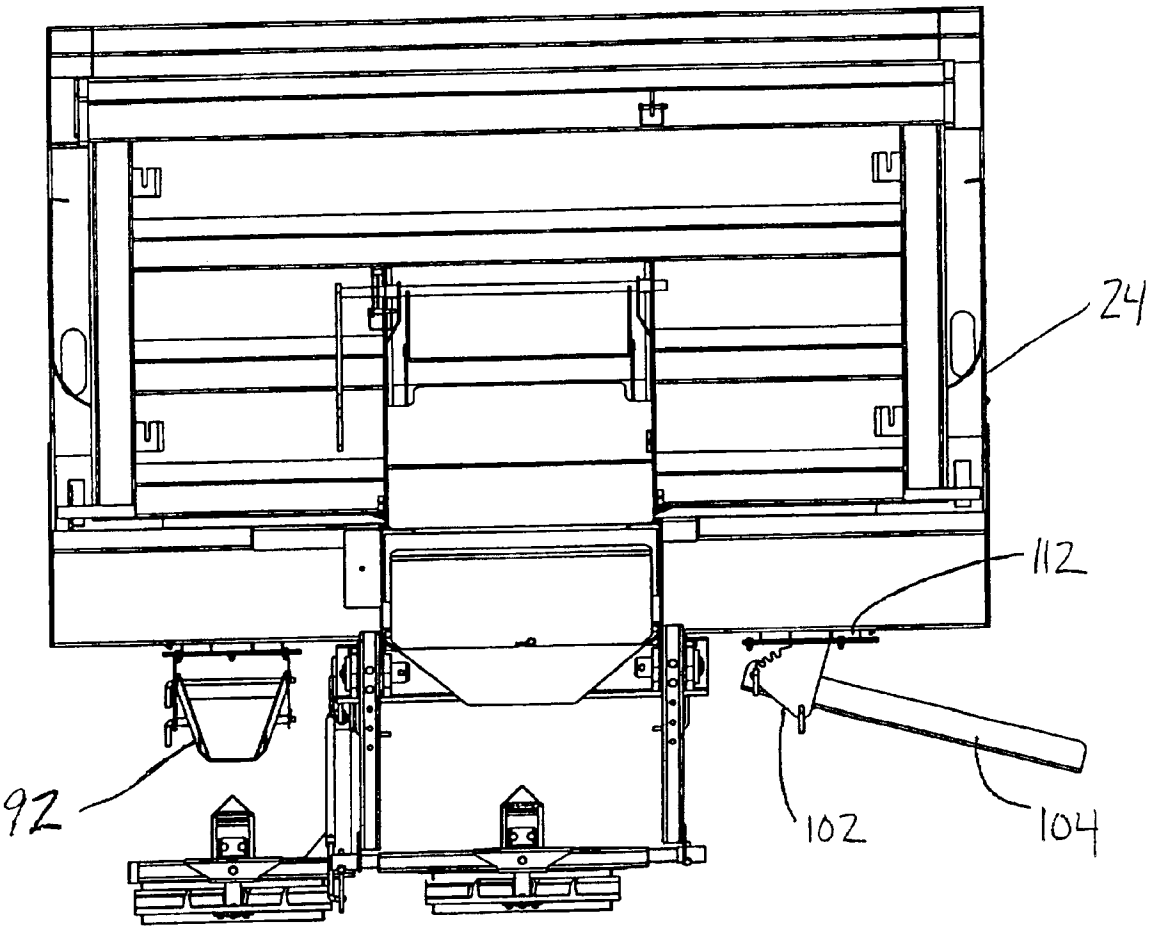
FIG. 22 is a rear end elevational view of the body of FIG. 7.

Referring to FIGS. 21 and 22, the second side chute 102 is pivotally mounted to the body 24. The second side chute 102 is rotatably mounted to the second discharge port 112. The chute 102 is operably arranged with the conveyor assembly to receive materials from the cross conveyor and to direct materials to the surface, such as a shoulder of a roadway. The second side chute 102 includes the elongated burming ramp 104 to facilitate the deposit of materials remotely from the vehicle 20. The burming ramp 104 can be used to deposit materials in a shoulder of a roadway to thereby increase the size of the shoulder. Advantageously, the burming ramp 104 allows for the convenient deposit of materials in the shoulder of the roadway while the vehicle 20 is located in an adjacent driving lane. The second side chute 102 is similar in other respects to the first side chute 92 shown and described herein.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Of course, variations of those preferred embodiments will become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A vehicle comprising:

a chassis;

a combination body for selectively dumping and spreading materials, the body pivotably secured to the chassis at a hinge, the body comprised of front and rear ends and first and second side walls;

a hoist extending between the body and the chassis for pivoting the body about the hinge;

a conveyor assembly comprising an endless conveyor disposed between the side walls and extending beyond the rear end of the body;

a spreader for selectively spreading materials, the spreader adjustably mounted to the vehicle and cooperatively arranged with the conveyor assembly to receive materials, and wherein the spreader is selectively movable along a first axis, a second axis, and a third axis;

a spreader mounting assembly, the spreader mounting assembly mounted to the body, and the spreader adjustably mounted to the spreader mounting assembly, wherein the spreader mounting assembly Includes a support member and an adjustment mechanism, the support member secured to the body, the adjustment mechanism secured to the support member, and the adjustment mechanism allowing the spreader to selectively move along the first, second, and third axes, and wherein the adjustment mechanism includes first, second, and third adjustment members, the first adjustment member movably mounted to the support member such that the first adjustment member is selectively movable along die first axis, die second adjustment member movably mounted to the first adjustment member such that the second adjustment member is selectively movable along the second axis, the third adjustment member mounted to the second adjustment member, the spreader adjustably mounted to the third adjustment member such that the spreader is selectively movable along the third axis.

2. A vehicle comprising:

a chassis;

a combination body for selectively dumping and spreading materials, the body pivotably secured to the chassis at a hinge, the body comprised of front and rear ends and first and second side walls;

a hoist extending between the body and the chassis for pivoting the body about the hinge;

a conveyor assembly comprising an endless conveyor disposed between the side walls and extending beyond the rear end of the body;

a spreader for selectively spreading materials, the spreader adjustably mounted to the vehicle and cooperatively arranged with the conveyor assembly to receive materials, and wherein the spreader is selectively movable along a first axis, a second axis, and a third axis; and a spreader mounting assembly, the spreader mounting assembly mounted to the body, and the spreader adjustably mounted to the spreader mounting assembly, wherein the spreader mounting assembly includes a pair of support members and an adjustment mechanism, the adjustment mechanism having a pair of first adjustment members, a pair of second adjustment members, and a third adjustment member, the first adjustment members respectively movably mounted to the support members such that the first adjustment members are selectively movable along the first axis, the second adjustment members respectively movably mounted to the first adjustment members such that the second adjustment members are selectively movable along the second axis, the third adjustment member mounted to the second adjustment members, the spreader adjustably mounted to the third adjustment member such that the spreader is selectively movable along the third axis.

3. A vehicle comprising:

a chassis;

a combination body for selectively dumping and spreading materials, the body pivotably secured to the chassis at a hinge, the body comprised of front and rear ends and first and second side walls;

a hoist extending between the body and the chassis for pivoting the body about the hinge between first and second positions;

a conveyor assembly comprising an endless conveyor disposed between the side walls and extending beyond the rear end of the body; and a spreader for selectively spreading materials, the spreader cooperatively arranged with the conveyor assembly to receive materials, the spreader cooperatively arranged with the conveyor assembly to receive materials, the spreader including a disk, the disk defining a first spreader plane when the body is in the first position, the spreader pivotally mounted with respect to the body such that the disk defines a second spreader plane when the body is in the second position wherein the second spreader plane is substantially parallel to the first spreader plane;

a spreader mounting assembly, the spreader mounting assembly mounting the spreader to the body, the spreader mounting assembly including a member, a linkage, and a leveling leg, the member including an axis about which the member is rotatable, the spreader mounted to the member, the linkage mounted to the member and pivotally mounted to the leveling leg, the leveling leg pivotally mounted to the chassis, and the hinge, the member, the linkage, and the leveling leg defining a four-bar linkage system.

4. The vehicle of claim 3 wherein the first spreader plane and the second spreader plane are both substantially horizontal.

5. A vehicle comprising:

a chassis;

a combination body for selectively dumping and spreading materials, the body pivotably secured to the chassis at a hinge, the body comprised of front and rear ends and first and second side walls;

a hoist extending between the body and the chassis for pivoting the body about the hinge;

a conveyor assembly comprising an endless conveyor disposed between the side walls and extending beyond the rear end of the body; and a spreader for selectively spreading materials, the spreader adjustably mounted to the vehicle and cooperatively arranged with the conveyor assembly to receive materials, and wherein the spreader is selectively movable along a first axis, a second axis, and a third axis, wherein the first axis, the second axis, and the third axis are mutually perpendicular to each other.

6. The vehicle of claim 5 wherein the first axis, the second axis, and the third axis are a longitudinal axis, a transverse axis, and a vertical axis, respectively.

7. The vehicle of claim 5 wherein the spreader is adjustable along the first, second, and third axes relative to the conveyor assembly for assisting in the receipt of materials therefrom.

8. The vehicle of claim 5 further comprising:

a spreader mounting assembly, the spreader mounting assembly mounted to the body, and the spreader adjustably mounted to the spreader mounting assembly.

9. The vehicle of claim 8 wherein the spreader mounting assembly includes a support member and an adjustment mechanism, the support member secured to the body, the adjustment mechanism secured to the support member, and the adjustment mechanism allowing the spreader to selectively move along the first, second, and third axes.

10. The vehicle of claim 9 wherein the adjustment mechanism includes first, second, and third adjustment members, the first adjustment member movably mounted to the support member such that the first adjustment member is selectively movable along the first axis, the second adjustment member movably mounted to the first adjustment member such that the second adjustment member is selectively movable along the second axis, the third adjustment member mounted to the second adjustment member, the spreader adjustably mounted to the third adjustment member such that the spreader is selectively movable along the third axis.

11. The vehicle of claim 8 wherein the spreader mounting assembly includes a pair of support members and an adjustment mechanism, the adjustment mechanism having a pair of first adjustment members, a pair of second adjustment members, and a third adjustment member, the first adjustment members respectively movably mounted to the support members such that the first adjustment members are selectively movable along the first axis, the second adjustment members respectively movably mounted to the first adjustment members such that the second adjustment members are selectively movable along the second axis, the third adjustment member mounted to the second adjustment members, the spreader adjustably mounted to the third adjustment member such that the spreader is selectively movable along the third axis.

12. The vehicle of claim 5 wherein the spreader is incrementally movable along at least one of the first, second, and third axes.

13. A vehicle comprising:

a chassis;

a body for selectively storing materials, the body comprised of front and rear ends and first and second side walls;

a conveyor assembly comprising an endless conveyor disposed between the side walls and extending beyond the rear end of the body;

a spreader for selectively spreading materials, the spreader cooperatively arranged with the conveyor assembly to receive materials, and the spreader adjustably mounted to the chassis such that the spreader is movable along a first, wherein the spreader is movable along a second axis and a third axis, the first second, and third axes being mutually perpendicular, the spreader incrementally movable along at least one of the first, second, and third axes.

14. The vehicle of claim 13 wherein the spreader is rotatable about the first axis.

15. The vehicle of claim 13 wherein the first axis is vertical.

16. The vehicle of claim 13 wherein, the conveyor assembly includes a cross conveyor, the spreader being arranged to receive materials from the cross conveyor.

17. The vehicle of claim 14 further comprising:

a spreader mounting assembly, the spreader mounting assembly mounting the spreader to the chassis, the spreader mounting assembly including an arm, the spreader mounted to the arm, the arm rotatable about the first axis, the arm movably mounted to the chassis, the arm movable along the first axis.

18. The vehicle of claim 17 wherein the spreader is movably mounted to the arm.

19. The vehicle of claim 18 wherein the arms is L-shaped.

* * * * *

UNITED STATES PATENT AND TRADEMARK OFFICE

CERTIFICATE OF CORRECTION

PATENT NO. : 6,945,482 B2
DATED : September 20, 2005
INVENTOR(S) : Mark S. Hollinrake et al.

It is certified that error appears in the above-identified patent and that said Letters Patent is hereby corrected as shown below:

Column 15,
Line 20, “assembly Includes” should read -- assembly includes --.
Line 30, “axis, die” should read -- axis, the --.

Column 18,
Line 16, “first second,” should read -- first, second, --.

Signed and Sealed this

Twenty-ninth Day of November, 2005

JON W. DUDAS
*Director of the United States Patent and Trademark Office*

UNITED STATES PATENT AND TRADEMARK OFFICE

CERTIFICATE OF CORRECTION

PATENT NO. : 6,945,482 B2
APPLICATION NO. : 10/212599
DATED : September 20, 2005
INVENTOR(S) : Hollinrake et al.

It is certified that error appears in the above-identified patent and that said Letters Patent is hereby corrected as shown below:

Claim 1, column 15, line 30: "die first axis" should read -- the first axis --

Claim 13, column 18, line 15: "a first," should read -- a first axis --

Signed and Sealed this

Twenty-sixth Day of January, 2010

David J. Kappos

David J. Kappos
*Director of the United States Patent and Trademark Office*